US008454136B2

(12) United States Patent
Katoh et al.

(10) Patent No.: US 8,454,136 B2
(45) Date of Patent: Jun. 4, 2013

(54) INK CARTRIDGE AND IMAGE FORMING APPARATUS EMPLOYING THE INK CARTRIDGE

(75) Inventors: Tomomi Katoh, Ebina (JP); Tadashi Hayakawa, Yokohama (JP); Ikoh Soh, Atsugi (JP); Toshiroh Tokuno, Machida (JP); Akiko Bannai, Atsugi (JP); Shotaro Takeuchi, Atsugi (JP); Masahiro Kuwata, Atsugi (JP); Masanori Kusunoki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 415 days.

(21) Appl. No.: 12/769,189

(22) Filed: Apr. 28, 2010

(65) Prior Publication Data

US 2010/0277555 A1 Nov. 4, 2010

(30) Foreign Application Priority Data

Apr. 30, 2009 (JP) ..... 2009-110988
May 18, 2009 (JP) ..... 2009-120365

(51) Int. Cl.
*B41J 2/175* (2006.01)

(52) U.S. Cl.
USPC ..... 347/85

(58) Field of Classification Search
USPC ..... 347/7, 49, 84, 85, 86, 87
See application file for complete search history.

(56) References Cited

U.S. PATENT DOCUMENTS

| | | | | |
|---|---|---|---|---|
| 4,415,886 | A * | 11/1983 | Kyogoku et al. | 340/618 |
| 6,296,353 | B1 * | 10/2001 | Thielman et al. | 347/86 |
| 6,796,627 | B2 * | 9/2004 | Kimura et al. | 347/7 |
| 7,325,908 | B2 | 2/2008 | Katoh et al. | |
| 7,404,628 | B2 * | 7/2008 | Naka et al. | 347/86 |
| 7,540,598 | B2 | 6/2009 | Hori et al. | |
| 7,984,963 | B2 * | 7/2011 | Karppinen et al. | 347/35 |
| 8,123,341 | B2 * | 2/2012 | Kimura | 347/86 |
| 2005/0073559 | A1 | 4/2005 | Aruga et al. | |
| 2009/0256892 | A1 | 10/2009 | Takeuchi | |
| 2009/0290002 | A1 | 11/2009 | Katoh | |

FOREIGN PATENT DOCUMENTS

| | | |
|---|---|---|
| JP | 3570714 | 7/2004 |
| JP | 3606282 | 10/2004 |
| JP | 3775650 | 3/2006 |
| JP | 2006-327111 | 12/2006 |
| JP | 2008-230010 | 10/2008 |

* cited by examiner

*Primary Examiner* — Anh T. N. Vo
(74) *Attorney, Agent, or Firm* — Cooper & Dunham LLP

(57) ABSTRACT

An ink cartridge removably mountable in an image forming apparatus includes a flexible storage member, a pressurization-space formation member, an output port, and an opening-and-closing assembly. The flexible storage member stores ink. The pressurization-space formation member hermetically houses the storage member and forms a pressurization space to which a fluid is supplied between the pressurization-space formation member and the storage member. The output port is connected to the storage member, through which the ink is supplied from the storage member to the image forming apparatus. The opening-and-closing assembly opens and closes between the output port and the storage member by the fluid supplied into the pressurization space.

15 Claims, 20 Drawing Sheets

INK CARTRIDGE AND IMAGE FORMING APPARATUS EMPLOYING THE INK CARTRIDGE

CROSS-REFERENCE TO RELATED APPLICATIONS

The present patent application claims priority pursuant to 35 U.S.C. §119from Japanese Patent Application Nos. 2009-110988, filed on Apr. 30, 2009 and 2009-120365, filed on May 18, 2009 in the Japan Patent Office, each of which is incorporated herein by reference in its entirety.

BACKGROUND OF THE INVENTION

1. Field of the Invention

Illustrative embodiments of the present disclosure relate to an ink cartridge and an image forming apparatus employing the ink cartridge, and more specifically to an image forming apparatus including a recording head for ejecting droplets of liquid and an ink cartridge removably mounted in the image forming apparatus.

2. Description of the Background

Image forming apparatuses are used as printers, facsimile machines, copiers, multi-functional peripherals having two or more of the foregoing capabilities, or plotters. As one type of image forming apparatus employing a liquid-ejection recording method, an inkjet recording apparatus is known that uses a recording head for ejecting droplets of ink.

In image formation, such image forming apparatuses employing the liquid-ejection recording method eject droplets of ink or other liquid from the recording head onto a recording medium to form a desired image (hereinafter "image formation" is used as a synonym for "image recording" and "image printing"). Such liquid-ejection-type image forming apparatuses fall into two main types: a serial-type image forming apparatus that forms an image by ejecting droplets from the recording head while moving the recording head in a main scan direction, and a line-head-type image forming apparatus that forms an image by ejecting droplets from a linear-shaped recording head held stationary in the image forming apparatus.

With recent increases in the operation speed, such liquid-ejection-type image forming apparatuses (hereinafter also referred to as "inkjet recording apparatus") have become widespread for not only home use but also business use. Further, there is an increased demand for forming an image on a recording medium of a large width. For business use, such an inkjet recording apparatus is provided with an ink cartridge capable of storing a large volume of ink, to reduce the frequency of cartridge replacement.

Accordingly, instead of a system in which the ink cartridge is directly mounted on the recording head, such inkjet recording apparatuses may employ a system in which the ink cartridge (also referred to as "main tank" or "main cartridge") is removably mounted in the image forming apparatus and connected to the recording head mounted on, e.g., a carriage via a tube to supply ink, an arrangement that is also referred to as a tube supply system.

With the tube supply system, ink consumed for image formation is supplied from the ink cartridge to the recording head via the tube. However, this system is not without its problems. For example, using a flexible thin tube may cause substantial fluid resistance for ink passing through the tube and prevent ink from being supplied on time for ink ejection, resulting in ejection failure. In particular, a large-size image forming apparatus that forms an image on a large-width recording medium necessarily uses a relatively long tube, resulting in increased fluid resistance of the tube. Further, high-speed recording or ejection of high-viscosity ink may increase the fluid resistance of the tube, causing ink supply shortage in the recording head.

Hence, for example, in one conventional technique like that described in JP-3606282-B, ink is kept at a pressurized state in the ink cartridge and a differential-pressure regulating valve is disposed upstream of the recording head in the ink supply direction to supply ink when negative pressure in the sub tank exceeds a threshold level.

Such a configuration may prevent the above-described ink supply (refill) shortage. However, as ink is pressurized, positive pressure may remain in the ink supply pathway. Consequently, when the ink cartridge is removed from the recording apparatus, such residual pressure may cause ink leakage from a connecting portion between the ink cartridge and the inkjet recording apparatus.

Hence, in another conventional technique like that described in JP-3775650-B, a valve that regulates air pressure to pressurize ink is driven with an electromagnetic plunger to release the pressure in the air passage to prevent such ink leakage. Similarly, in still another conventional technique like that described in JP-2008-230010-A, ink is supplied with air pressure from the ink cartridge via the ink supply pathway. A portion of the ink supply pathway is made of a flexible film so as to be able to change volume, and the ink cartridge is pressurized with air from the outside. With such a configuration, when the ink cartridge is removed, the ink supply pathway itself absorbs the residual pressure of ink to prevent ink leakage.

However, the configurations of the above-described conventional techniques like those of JP-3775650-B and JP-2008-230010-A are intended simply to release the air pressure and thus may not prevent ink from leaking from the ink cartridge or the connection portion of the inkjet recording apparatus when the ink cartridge is removed from the inkjet recording apparatus.

SUMMARY OF THE INVENTION

In an illustrative embodiment, an ink cartridge removably mountable in an image forming apparatus includes a flexible storage member, a pressurization-space formation member, an output port, and an opening-and-closing assembly. The flexible storage member stores ink. The pressurization-space formation member hermetically houses the storage member and forms a pressurization space to which a fluid is supplied between the pressurization-space formation member and the storage member. The output port is connected to the storage member and the ink is supplied from the storage member to the image forming apparatus through the output port. The opening-and-closing assembly opens and closes between the output port and the storage member by the fluid supplied into the pressurization space.

In another illustrative embodiment, an image forming apparatus includes a recording head, an ink cartridge, a pressurization device, a delivery tube, and an opening-and-closing assembly. The recording head ejects droplets of ink. The ink cartridge includes a storage member that stores ink to be delivered to the recording head. The pressurization device applies pressure on the storage member of the ink cartridge. Ink of the ink cartridge is delivered to the recording head through the delivery tube. The opening-and-closing assembly is driven with the pressurization device to open and close the delivery tube.

In still another illustrative embodiment, a recording-liquid container used in an image forming apparatus to store a recording liquid includes a deformable storage member, a recording-liquid supply member, and a plurality of electrodes. The deformable storage member stores the recording liquid and has at least two deformable opposing side walls. The recording-liquid supply member is mounted on the storage member to receive a recording-liquid introduction member of the image forming apparatus. The plurality of electrodes is disposed on the at least two deformable opposing side walls of the storage member. A residual amount of the recording liquid in the storage member is determined by a contact state between the plurality of electrodes.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
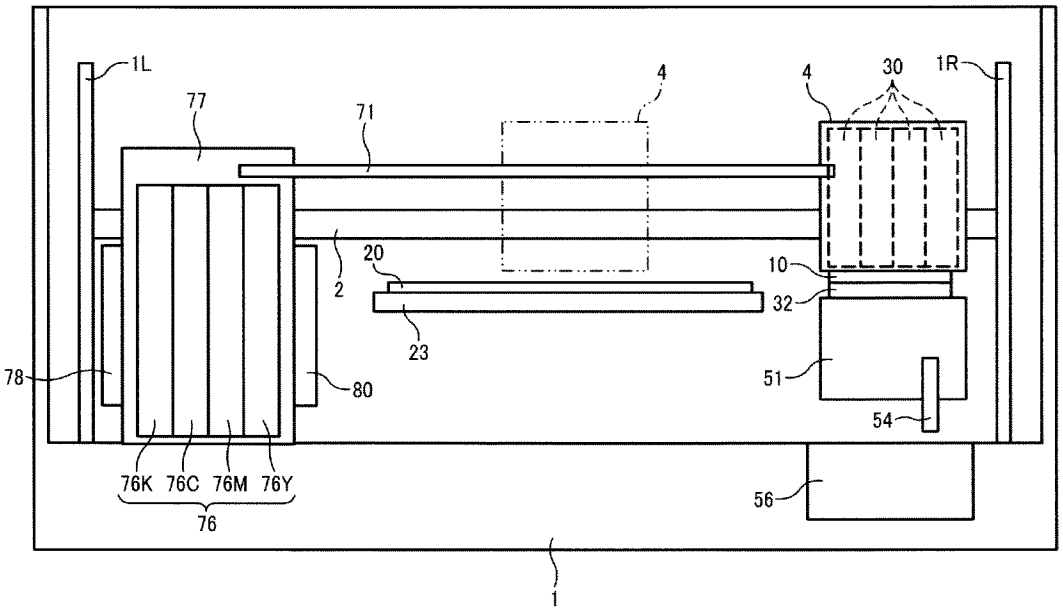
FIG. 1 is a front perspective view illustrating an inkjet recording apparatus as an example of an image forming apparatus according to illustrative embodiments of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In this disclosure, the term "image forming apparatus" refers to an apparatus (e.g., droplet ejection apparatus or liquid ejection apparatus) that ejects ink or any other liquid on a medium to form an image on the medium. The medium is made of, for example, paper, string, fiber, cloth, leather, metal, plastic, glass, timber, and ceramic. The term "image formation" used herein includes providing not only meaningful images such as characters and figures but meaningless images such as patterns to the medium. The term "ink" used herein is not limited to "ink" in a narrow sense and includes anything useable for image formation, such as a DNA sample, resist, pattern material, washing fluid, storing solution, and fixing solution. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, or a recording sheet.

Although the illustrative embodiments are described with technical Limitations with reference to the attached drawings, such description is not intended to limit the scope of the present invention and all of the components or elements described in the illustrative embodiments of this disclosure are not necessarily indispensable to the present invention.

Below, illustrative embodiments according to the present disclosure are described with reference to attached drawings.

As an example of an image forming apparatus according to an illustrative embodiment of the present disclosure, an inkjet recording apparatus is described with reference to FIGS. 1 to 3.

FIG. 1 is a front perspective view illustrating the inkjet recording apparatus according to the present illustrative embodiment. FIG. 2 is a schematic plan view illustrating the inkjet recording apparatus. FIG. 3 is a schematic side view illustrating the inkjet recording apparatus.

The inkjet recording apparatus includes a main frame 1, a guide rod 2, a guide rail 3 and a carriage 4. The guide rod 2 is a guide member extended between two, left and right, side plates 1L and 1R that are vertically disposed on the frame 1. The guide rail 3 is mounted on a rear frame 1B that is bridged over the main frame 1. The carriage 4 is slidably held with the guide rod 2 and the guide rail 3. The carriage 4 is moved with a main scan motor, not illustrated, via a timing belt for scanning in a long direction of the guide rod 2, i.e., a main scan direction.

On the carriage 4 are mounted one or more (four in this example) recording heads 10 that eject droplets of different color inks of, e.g., black (K), cyan (C), magenta (M), and yellow (Y). The recording heads 10 are mounted on the carriage 4 so that a plurality of nozzles is arranged in a direction (sub-scanning direction) perpendicular to the main scan direction and ink droplets are ejected downward from the nozzles.

Figure 4:
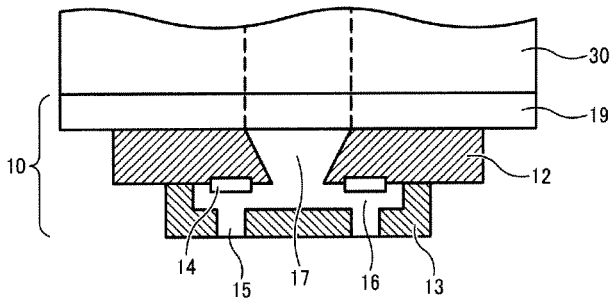
FIG. 4 is an enlarged view illustrating a portion of a recording head used in the inkjet recording apparatus.
Figure 9:
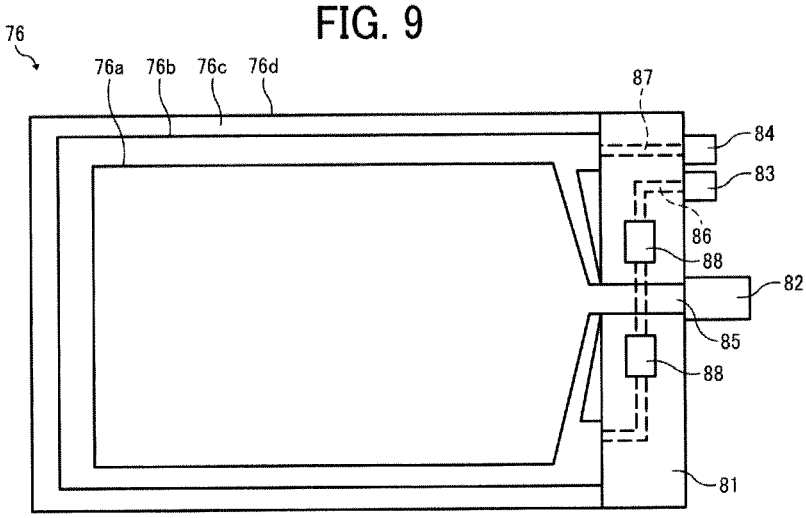
FIG. 9 is a schematic front view illustrating an ink cartridge.

As illustrated in FIG. 9, each of the recording heads 10 includes a heater substrate 12 and a chamber formation member 13. Ink is supplied from a channel formed in a head-base member 19 via a common channel 17 to a chamber (individual channel) 16 to be ejected from a nozzle 15. In FIG. 4, the recording heads 10 are a thermal type in which driving a heater 14 causes film boiling of ink to generate ejection pressure and a side-shooter type in which a flow direction of ink toward an ejection-energy acting portion (around the heater 19) in the chamber 16 is perpendicular to an opening central axis of the nozzle 15.

It is to be noted that the recording heads may be, e.g., a piezoelectric type in which a diaphragm is deformed with a piezoelectric element to generate ejection pressure or an electrostatic type in which a diaphragm is deformed with electrostatic force to generate ejection pressure. Any suitable type is used in the image forming apparatus according to the present illustrative embodiment.

A sheet 20 on which an image is to be formed with the recording heads 10 is conveyed in the sub-scan direction perpendicular to the main scan direction and positioned below the carriage 4. As illustrated in FIG. 3, the sheet 20 is sandwiched with a conveyance roller 21 and a press roller 22 and conveyed to an image formation area (print area) at which an image is formed with the recording heads 10. When the sheet 20 is conveyed onto a print guide member 13, a pair of output rollers 24 feeds the sheet 20 in a sheet output direction.

The scanning of the carriage 4 in the main scan direction is synchronized with the ejection of ink droplets from the recording heads 10 at a proper timing based on image data to form one band of an image on the sheet 20. After the formation of the one band of the image, the sheet 20 is fed by a certain amount in the sub scan direction to perform the above-described recording operation. The recording operation is repeatedly performed until one page of the image is formed.

A plurality of sub tanks 30 (also called "buffer tanks" or "head tanks") including ink chambers that temporarily store ink to be ejected from the recording heads 10 is integrally connected to an upper portion of the recording heads 10. The term "integrally" used herein means that the recording heads 10 are connected to the sub tanks 30 via tubes or pipes and both the recording heads 10 and the sub tanks 30 are mounted on the carriage 4.

Ink cartridges (main tanks) 76 serving as liquid containers (tanks) that contain different color inks are removably attached to a cartridge holder 77 that is disposed at one end in the main scan direction of the inkjet recording apparatus. Different color inks are supplied from the ink cartridges 76 to the sub tanks 30 through liquid supply tubes 71 that form a portion of an ink supply pathway.

At a non-print area on the other end in the main-scan direction of the carriage 4 is disposed a maintenance unit 51 (hereinafter also referred to as "sub-system") that maintains nozzle conditions of the recording heads 10. The maintenance unit 51 includes caps 52 that cover the respective nozzle faces of the recording heads 10, a suction pump 53 that suctions the interiors of the caps 52, a discharge passage 54 that discharges waste ink suctioned with the suction pump 53. Such waste ink discharged from the discharge passage 54 is received with a waste-liquid tank 56 that is disposed on the main frame 1.

Next, an example of the sub tanks is described with reference to FIGS. 5 and 6.

Figure 5:
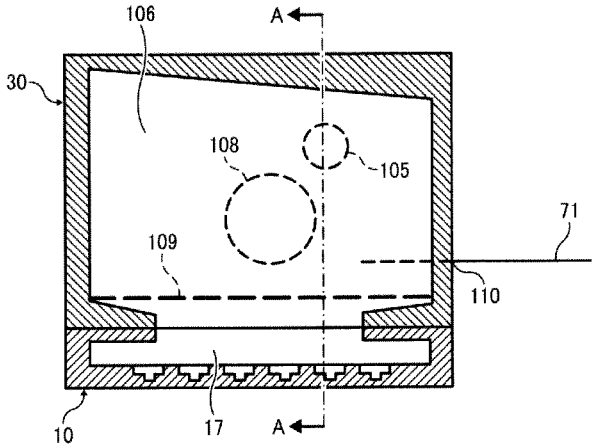
FIG. 5 is a schematic front cross-sectional view illustrating a sub tank of an ink supply system used in the inkjet recording apparatus.

FIG. 5 is a schematic front cross-sectional view illustrating one of the sub tanks 30. FIG. 6 is a schematic side cross-sectional view illustrating the sub tank 30 cut along a line A-A illustrated in FIG. 5. It is to be noted that, for simplicity or easier understanding, several components are omitted from FIGS. 5 and 6 and cross sections of several components are partially illustrated.

As illustrated in FIG. 6, the sub tank 30 includes two chambers: an ink chamber 106 and a pressurized chamber 102. In the ink chamber 106, a filter 109 is disposed near a connecting portion connected to the recording head 10 to filter ink. Thus, after dust and foreign materials are removed from ink, ink is supplied to the recording head 10.

A film member 107 is provided at an opening portion of a tank case 101 of the sub tank 30 to form the ink chamber 106. The film member 107 is biased with a biasing member 108, such as a spring, in a direction of increasing the volume of the sub tank 30. Thus, as illustrated in FIG. 6, the film member 107 is inflated in convex shape toward the exterior of the sub tanks 30.

Figure 6A:
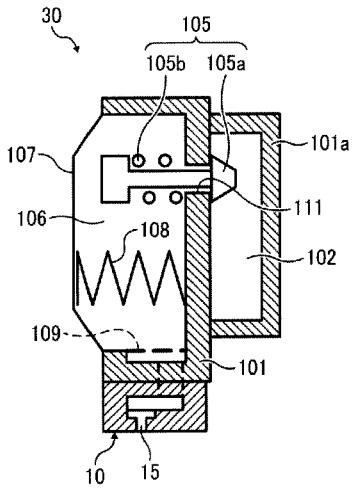
FIGS. 6A and 6B are schematic side cross-sectional views illustrating the sub tank cut along a line A-A illustrated in FIG. 5.
Figure 6B:
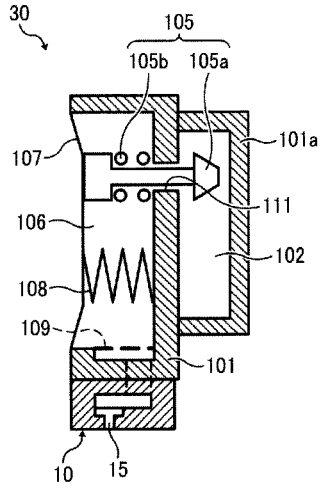

A pressurized-chamber case portion 101*a* constituting the pressurized chamber 102 is integrally provided with the tank case 101 at a side of the tank case 101 opposite a side at which the film member 107 is provided. A communication channel 111 is formed between the ink chamber 106 and the pressurized chamber 102, and a negative-pressure valve 105 is provided as a supply valve to open and close the communication channel 111. The negative-pressure valve 105 includes a valve member 105*a* movably inserted through the communication channel 111 and a second biasing member 105*b*, such as a spring, biasing in a direction in which the valve member 105*a* closes the communication channel 111. An end portion of the valve member 105*a* in the ink chamber 106 is disposed adjacent to the film member 107. Normally, the negative-pressure valve 105 maintains a non-communication state in which the communication channel 111 is closed as illustrated in FIG. 6A. By contrast, as illustrated in FIG. 6B, consumption of ink stored in the ink chamber 106 causes the film member 107 to displace toward the interior of the ink chamber 106. Thus, the valve member 105*a* moves to open the communication channel 111, thereby causing the ink chamber 106 to communicate the pressurized chamber 102.

Figure 2:
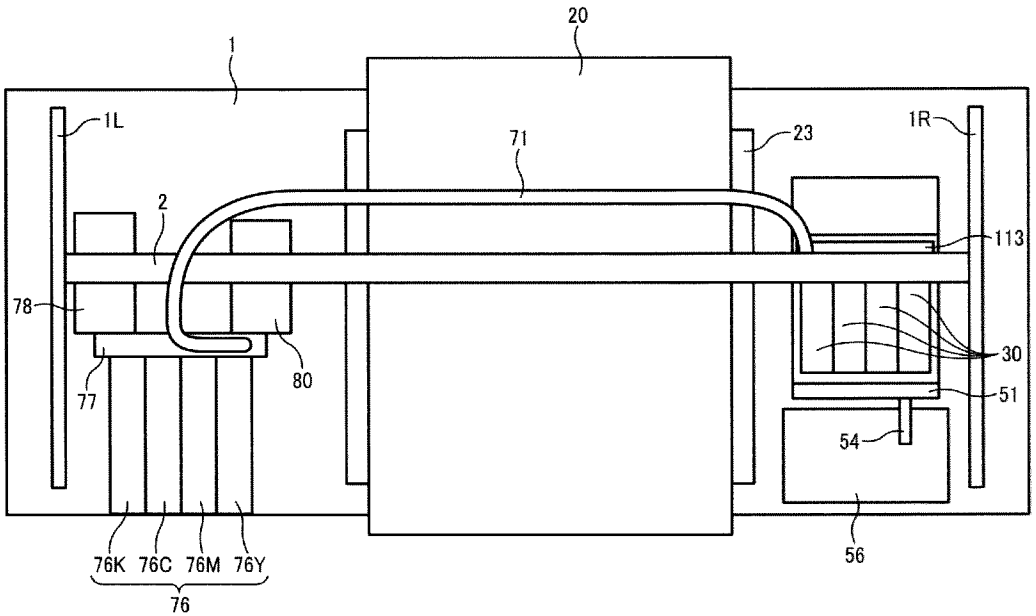
FIG. 2 is a schematic plan view illustrating the inkjet recording apparatus.
Figure 3:
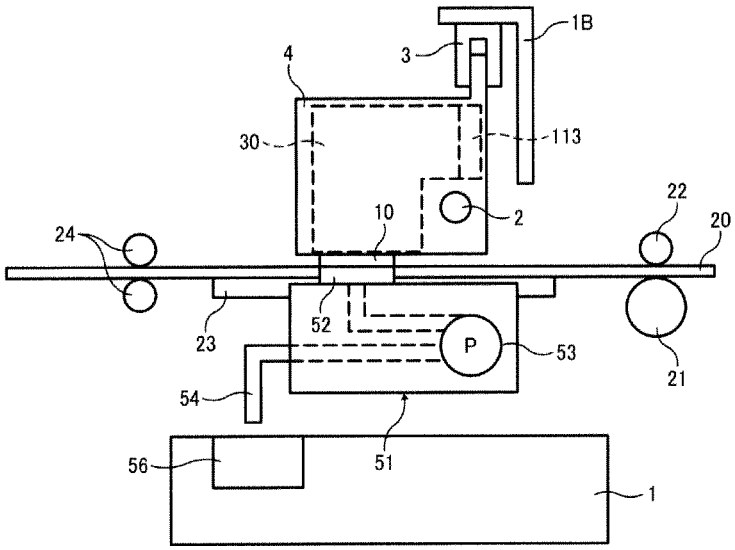
FIG. 3 is a schematic side view illustrating the inkjet recording apparatus.

At the pressurized chamber 102 of the sub tank 30 is provided an ink supply port 110 that is connected to a connection member 113 illustrated in FIGS. 2 and 3 so as to communicate the liquid supply tube 71.

Next, an ink supply system according to a first illustrative embodiment used in the image forming apparatus is described with reference to FIG. 7.

Figure 7:
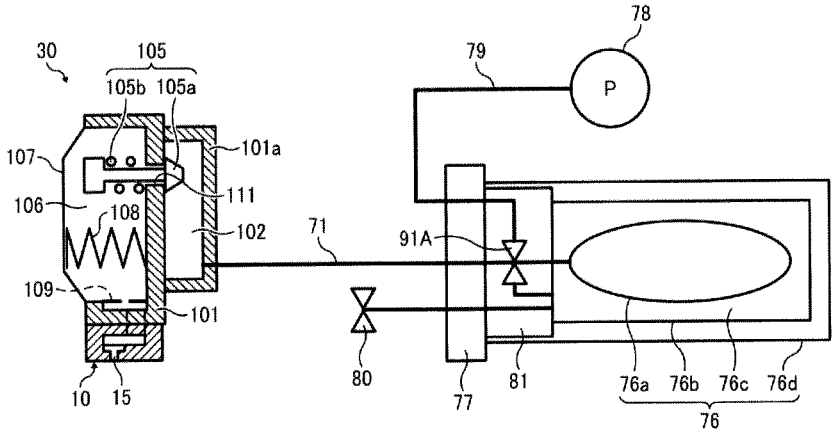
FIG. 7 is a schematic view illustrating a configuration of an ink supply system according to a first illustrative embodiment.

FIG. 7 is a schematic view illustrating a configuration of the ink supply system. It is to be noted that, in FIG. 7, the shapes or arrangement of several components are resealed for easy understanding.

The ink cartridge 76 includes an ink pack 76*a* serving as an ink storage member that stores ink, a pack member 76*b* that encloses the ink pack 76*a* in a sealed state and serves as a pressurization-space formation member forming a pressurization space (air space) 76*c* between the ink pack 76*a* and it, a case member 76*d*, and a spout (support member) 81. A fluid (e.g., air) is pumped with a pressure pump 78 serving as a pressurization device into the pressurization space 76*c* between the ink pack 76*a* and the pack member 76*b*. As a result, the ink pack 76*a* is pressed by the pressure generated in the pressurization space 76*c* to deliver ink from the ink pack 76*a* to the liquid supply tube 71.

As illustrated in FIGS. 1 and 2 described above, by installing the ink cartridge 76 to the cartridge holder 77, the ink cartridge 76 is set to the inkjet recording apparatus.

Figure 8:
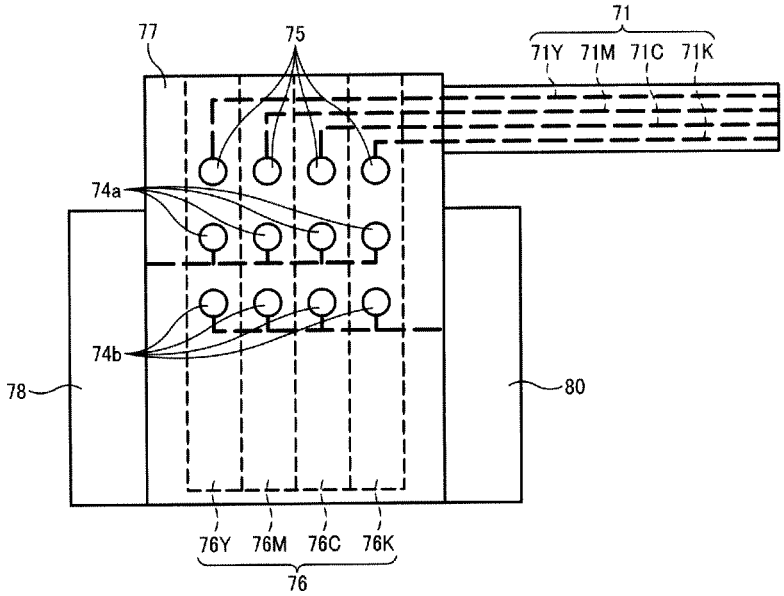
FIG. 8 is a schematic view illustrating a cartridge holder.

As illustrated in FIG. 8, ink ports 75 and air ports 74*a* and 74*b* are formed at a face of the cartridge holder 77 on which the ink cartridge 76 is mounted. With the ink cartridge 76 mounted on the cartridge holder 77 of the inkjet recording apparatus, as illustrated in FIG. 7, the liquid supply tube (ink supply tube) 71 is communicated with the ink pack 76*a* of the ink cartridge 76 via the ink ports 75. Further, the air space 76*c* of the ink cartridge 76 is communicated with an air supply tube 79 via the air ports 74*a*. The air supply tube 79 is connected to the pressure pump 78, and by pumping air into the air space 76*c* of the ink cartridge 76 using the pressure pump 78, pressure is applied to the ink pack 76*a*. The air space 76*c* of the ink cartridge 76 is connected to an air release valve 80 via the air ports 74*b*. The term "liquid (ink) supply tube 71" is used to collectively refer to ink supply tubes 71Y, 71M, 71C, and 71K.

The ink pack 76*a* of the ink cartridge 76 is communicated with the pressurized chamber 102 of the sub tanks 30 via the liquid supply tube 71 and the connection member 113. Thus, the pressure of ink in the pressurized chamber 102 is adjusted by driving the pressure pump 78.

Figure 10:
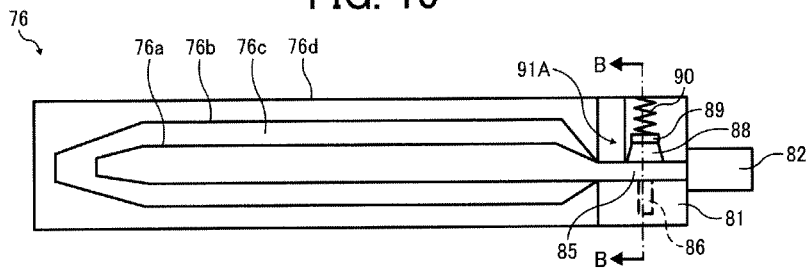
FIG. 10 is a schematic plan view illustrating the ink cartridge illustrated in FIG. 9.
Figure 11:
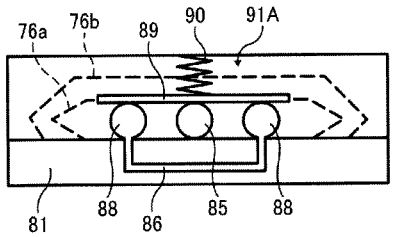
FIG. 11 is a schematic side cross-sectional view illustrating the ink cartridge cut along a line B-B illustrated in FIG. 10.

Next, details of the ink cartridge 76 are described with reference to FIGS. 9 to 11.

FIG. 9 is a schematic front view illustrating the ink cartridge 76. FIG. 10 is a schematic plan view illustrating the ink cartridge 76. FIG. 11 is a schematic side cross-sectional view illustrating the ink cartridge 76 cut along a line B-B illustrated in FIG. 10. In FIGS. 9 to 11, hatching representing cross sections of components are omitted for clarity.

The ink pack 76*a* and the pack member 76*b* are connectively fixed at the spout 81 that is fixed at the case member 76*d*. The ink pack 76*a* is connected to an ink output port 82 via a flexible tube member 85 which is a deformable member having flexibility serving as an ink passage.

The air space 76*c* between the ink pack 76*a* and the pack member 76*b* is connected to a first air port 83 via an air suction tube 86 and to a second air port 84 via an air output tube 87.

When the ink cartridge 76 is attached to the cartridge holder 77 to be connected to the inkjet recording apparatus, as illustrated in FIG. 7 described above, the first air port 83 is communicated with the pressure pump 78 via the air supply tube 79. Thus, by driving the pressure pump 78, air is pumped into the pressurization space, i.e., the air space 76*c* between the pack member 76*b* and the ink pack 76*a*. By contrast, as illustrated in FIG. 7, the second air port 84 is communicated with the atmosphere via the air release valve 80. Thus, by opening and closing the air release valve 80, the interior (the air space 76*c*) of the pack member 76*b* is opened or closed with respect to the atmosphere.

On the air suction tube 86 are provided two air-tube deformation portions 88 formed of deformable material having flexibility. The air-tube deformation portions 88 are also disposed near both sides of the flexible tube member 85. On the air-tube deformation portions 88 is movably provided a pressure plate 89 that is biased with a pressure spring 90, which is, e.g., a compression spring, in a direction to compress the flexible tube member 85 and the air-tube deformation portions 88. The flexible tube member 85, the air-tube deformation portion 88, the pressure plate 89, and the pressure spring 90 constitute an ink-passage valve assembly 91A that is an opening-and-closing assembly to open and close the ink passage between the ink pack 76*a* and the ink output port 82.

Next, operations of the ink cartridge 76 are described with reference to FIGS. 12 and 13.

Figure 12:
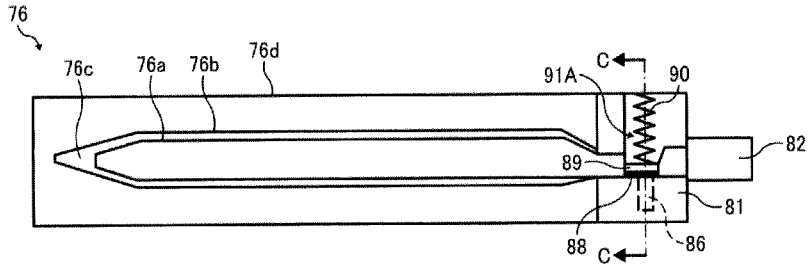
FIG. 12 is a schematic plan view illustrating operations of the ink cartridge.
Figure 13:
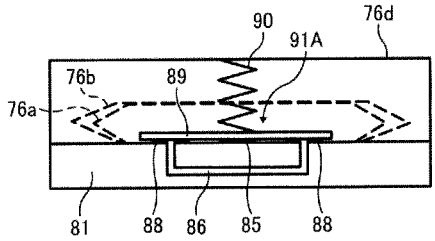
FIG. 13 is a schematic side cross-sectional view illustrating the ink cartridge cut along a line C-C illustrated in FIG. 12.

FIG. 12 is a schematic plan view illustrating operations of the ink cartridge 76. FIG. 13 is a schematic side cross-sectional view illustrating the ink cartridge 76 cut along a line C-C illustrated in FIG. 12.

For example, when the inkjet recording apparatus is halted, the pressure pump 78 is also halted and the air release valve 80 are opened. In such a state, the respective air passages connected to the air release valve 80, the air space 76*c*, and the pressure pump 78 are at atmospheric pressure. Hence, the flexible tube member 85 of the ink-channel valve assembly 91A is compressed (squeezed) by the pressure plate 89 biased by the pressure spring 90. Accordingly, as illustrated in FIGS. 12 and 13, the ink passage between the ink pack 76*a* and the ink output port 82 is closed.

Thus, even when a residual pressure remains in the ink pack 76*a* of the ink cartridge 76 while the inkjet recording apparatus is stopped, such a configuration prevents a failure that ink is gradually sent to the recording head 10. Further, such a configuration securely prevents ink leakage when the ink cartridge 76 is removed from the cartridge holder 77.

For example, in a conventional type of ink cartridge, an ink outlet port of the ink cartridge is formed of a seal member made of rubber or other material, and a hollow needle is provided at a cartridge receiving portion of a printer. By piercing the seal member with the hollow needle, an ink passage is open to supply ink. With such a configuration, when the conventional ink cartridge is removed from the cartridge receiving portion, a hole formed by the piercing of the hollow needle is closed by the flexibility of the seal member, thus preventing ink leakage. However, for the conventional ink cartridge, when the ink cartridge is repeatedly attached to and removed from the printer, the sealing performance of the seal member may deteriorate, causing ink leakage. Further, a hollow needle having a minute diameter used to pierce the seal member is expensive, resulting in an increased cost of the printer.

By contrast, with the above-described configuration according to the present illustrative embodiment, as destructive operation such as piercing is not performed for sealing, the sealing performance is not deteriorated by repeated attachment and removal of the ink cartridge. Further, the expensive hollow needle is not needed, allowing cost reduction of the image forming apparatus.

Next, a description is given of operation of the inkjet recording apparatus performed when the inkjet recording apparatus performs recording with the ink cartridge 76 mounted therein with reference to FIGS. 7 and 9 to 11.

When the inkjet recording apparatus receives a print instruction, the air release valve 80 illustrated in FIG. 8 is opened and the pressure pump 78 is driven to pump air into the air supply tube 79. The air goes into the pack member 76*b* through the air suction tube 86 of the ink cartridge 76 and the air pressure in the air space 76*c* increases over time. As a result, as illustrated in FIGS. 10 and 11, the air-tube deformation portions 88 inflate while resisting the biasing force of the pressure spring 90, thereby pushing up the pressure plate 89 having compressed the flexible tube member 85 for closure. In such a state, the interior of the ink pack 76*a* is communicated with the pressurized chamber 102 of the sub tank 30. Such a configuration allows supplying pressurized ink to the sub tank 30 at high speed when ink is ejected from the recording head 10.

As described above, in the ink cartridge according to the present illustrative embodiment, the opening-and-closing assembly (valve assembly) opens and closes the ink passage of the ink cartridge by using the pressure unit that supplies ink from the ink cartridge, thereby securely preventing ink leakage while recording operation is not performed.

As described above, the ink supply system according to the present illustrative embodiment includes the flexible ink-storage member that stores ink, the pressurization-space formation member that forms a pressurization space into which fluid is supplied between the ink storage member and it, the ink output port through which ink is supplied from the ink storage member to the inkjet recording apparatus, and the opening-and-closing assembly that opens and closes the ink passage between the ink output port and the ink storage member. By supplying fluid to the pressurization space, the opening-and-closing assembly opens and closes the ink passage between the ink output port and the ink storage member. Thus, the ink supply system securely prevents ink leakage when the ink cartridge is removed from the inkjet recording apparatus with a simple configuration. The ink supply system also performs the opening and closing of the opening-and-closing assembly by using the pressure unit that supplies ink, thus allowing a further simplified configuration.

Next, a second illustrative embodiment is described with reference to FIGS. 14 to 17.

Figure 14:
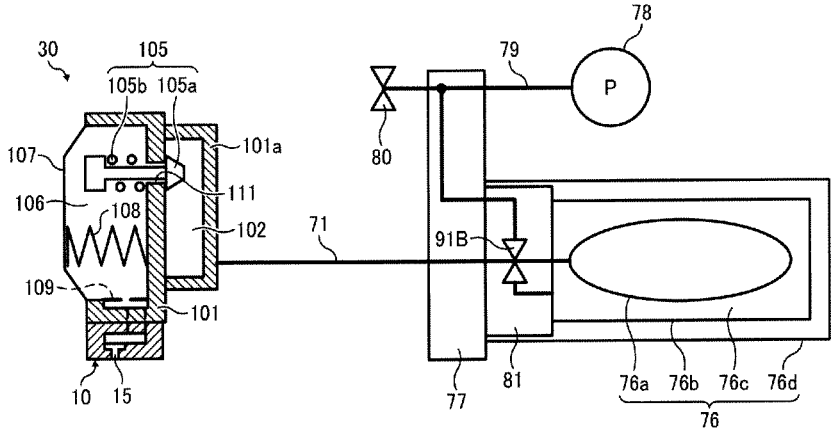
FIG. 14 is a schematic view illustrating a configuration of an ink supply system according to a second illustrative embodiment.
Figure 15:
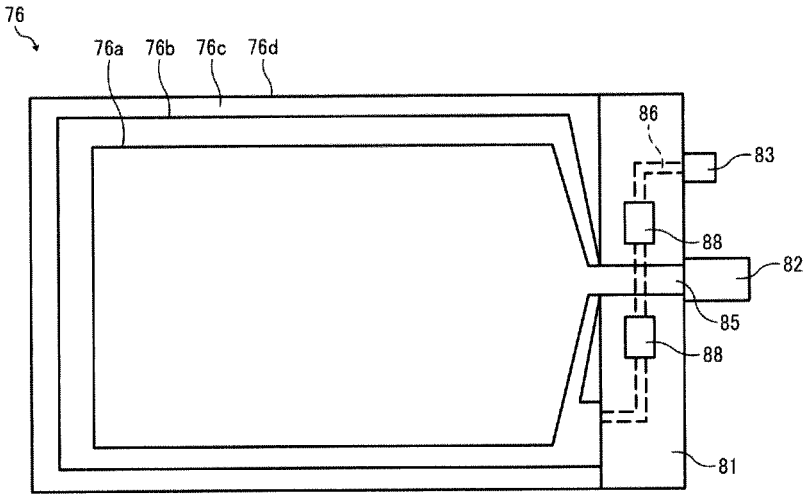
FIG. 15 is a schematic front view illustrating an ink cartridge.
Figure 16:
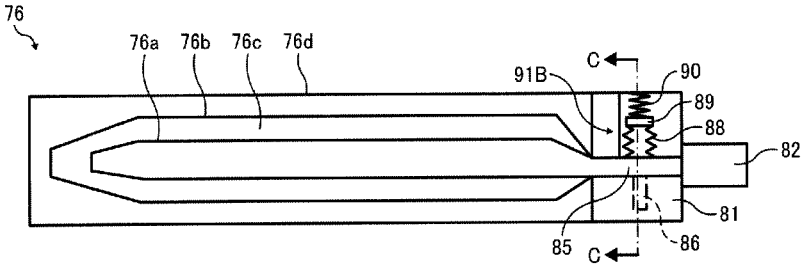
FIG. 16 is a schematic plan view illustrating the ink cartridge illustrated in FIG. 15.
Figure 17:
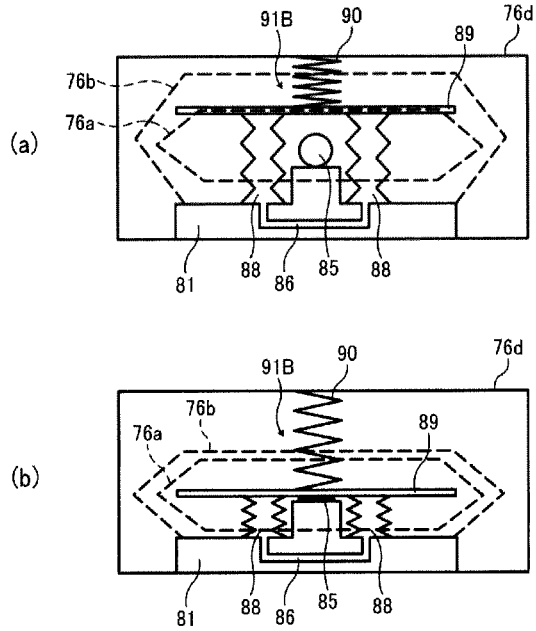
FIGS. 17A and 17B are schematic side cross-sectional views illustrating operations of an opening-and-closing assembly of the ink cartridge cut along a line C-C illustrated in FIG. 16.

FIG. 14 is a schematic view illustrating a configuration of an ink supply system according to the present illustrative embodiment. FIG. 15 is a schematic front view illustrating an ink cartridge 76. FIG. 16 is a schematic plan view illustrating the ink cartridge 76 illustrated in FIG. 15. FIGS. 17A and 178 are schematic side cross-sectional views illustrating operations of an opening-and-closing assembly of the ink cartridge 76 cut along a line C-C illustrated in FIG. 16.

As illustrated in FIGS. 16, 17A, and 17B, air-tube deformation portions 88 of the ink cartridge 76 in the present illustrative embodiment have an accordion structure that is smoothly extendable and contractible.

FIG. 17A shows a state in which the air-tube deformation portions 88 are extended by air pressure to raise a pressure plate 89. In such a state, a flexible tube member 85 returns from the compressed shape to the original shape by its flexibility. As a result, the flexible tube member 85 is opened so that ink of an ink pack 76*a* can be outputted (supplied) to a liquid supply tube 71.

To create such a state, in FIG. 14, an air release valve 80 is opened and air is pumped into an air supply tube 79 with a pressure pump 78. In other words, as with the above-described illustrative embodiment, by pumping air to the ink cartridge 76 with the pressure pump 78, the air-tube deformation portions 88 are extended to communicate (open the ink passage between) the ink cartridge 76 and the liquid supply tube 71, and at the same time, ink of the ink pack 76*a* is pressurized. Thus, as with the above-described illustrative embodiment, such a configuration allows high-viscosity ink to be supplied to the recording head 10 at high speed in conjunction with a negative-pressure valve 105 of a sub tank 30.

When ink need not be supplied, the air release valve 80 is opened with the pressure pump 78 stopped. As a result, the pressurized state of the passage between the air supply tube 79 and an air space 76*c* of the ink cartridge 76 is reduced to atmospheric pressure. Thus, as illustrated in FIG. 17B, the pressure plate 89 moves down by action of a pressure spring 90 to compress the flexible tube member 85, thereby closing the ink passage.

Thus, even if residual pressure remains in the ink cartridge 76 depending on a state of the ink pack 76*a*, the above-described configuration prevents ink from gradually moving to the ink supply tube due to the residual pressure, thereby preventing failures such as ink leakage from the recording head 10. The above-described configuration also prevents ink leakage from the ink cartridge 76 when the ink cartridge 76 is removed.

In the present illustrative embodiment, as illustrated in FIG. 17B, when the flexible tube member 85 is closed by the compression of the pressure plate 89, the air-tube deformation portions 88 are not completely collapsed. In the above-described illustrative embodiment, two separate air ports (the first air port 83 and the second air port 84) are provided to input and output air to and from the ink cartridge 76 as illustrated in FIG. 9. By contrast, in the present illustrative embodiment, as illustrated in FIG. 15, air is inputted and outputted through only a first air port 83, thus reducing the connecting points to the cartridge holder 77 and allowing a further simplified configuration.

Next, a third illustrative embodiment is described with reference to FIGS. 18, 19A, 19B, and 19C.

Figure 18:
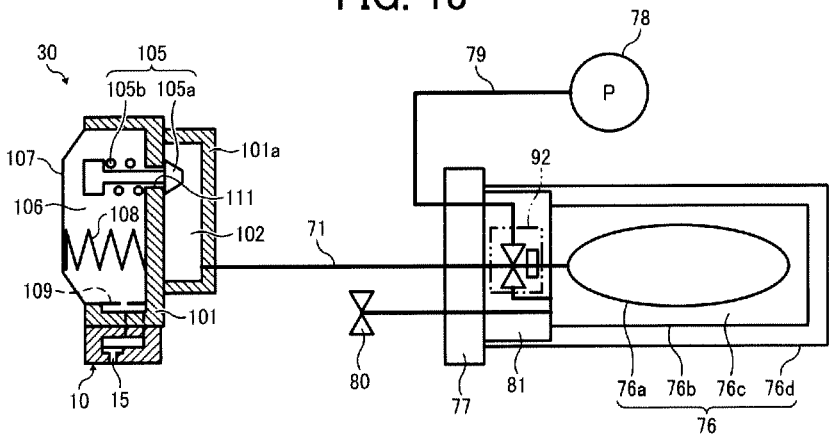
FIG. 18 is a schematic view illustrating a configuration of an ink supply system according to a third illustrative embodiment.
Figure 19:
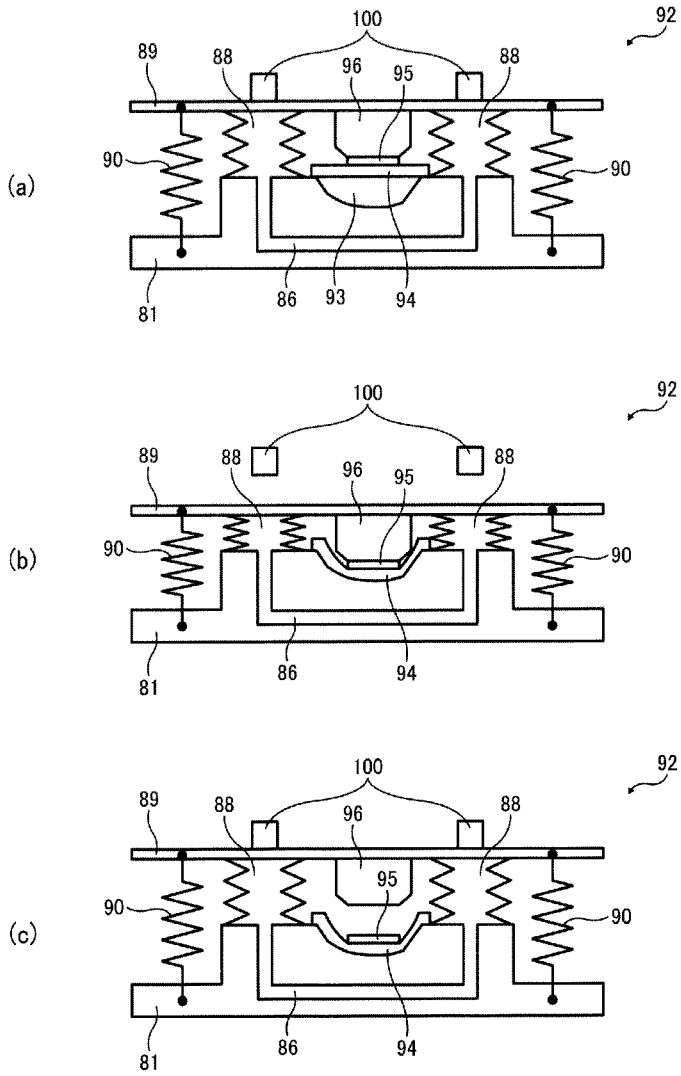
FIGS. 19A to 19C are schematic side cross-sectional views illustrating operations of an opening-and-closing assembly of an ink cartridge.

FIG. 18 is a schematic view illustrating a configuration of an ink supply system according to the third illustrative embodiment. FIGS. 19A to 19C are schematic side cross-sectional views illustrating operations of an opening-and-closing assembly of an ink cartridge 76.

The ink supply system according to the present illustrative embodiment has the same configuration as the ink supply system according to the first illustrative embodiment except for an ink-passage valve assembly 92. Therefore, the configuration and operation of the ink-passage valve assembly 92 are described with reference to FIGS. 19A to 19C.

In the ink cartridge 76 according to the present illustrative embodiment, a spout 81 is provided with an ink-passage groove 93. A top of the ink-passage groove 93*a* is covered with an elastic member 94 that is elastically deformable, thus forming an ink passage including a deformable portion between an ink pack 76*a* and an ink output port 82. On the elastic member 94 is disposed a first electrode 95. Above the first electrode 95 is provided a second electrode 96 that is fixed on a pressure plate 89 and also serves as a press member to press the elastic member 94. The pressure plate 89 is biased downward with pressure springs 90 that are extension springs disposed at both end portions thereof. Above the pressure plate 89 are disposed stoppers 100.

When the inkjet recording apparatus including the ink supply system is not in operation, as with the above-described illustrative embodiment, an air release valve 80 illustrated in FIG. 18 is opened and the air passage of the ink cartridge 76 is not pressurized. At this time, as illustrated in FIG. 19B, in the ink-passage valve assembly 92, the second electrode 96 is moved down by action of the pressure spring 90 to deform the elastic member 94 toward the ink-passage groove 93, thus closing the ink passage. Such a configuration prevents ink of the ink pack 76*a* from leaking out of the ink cartridge 76.

By contrast, when the inkjet recording apparatus is activated for recording, a pressure pump 78 is driven to pump air into an air space 76*c* of the ink cartridge 76 via an air supply tube 79. Thus, as illustrated in FIG. 19A, the volume of the air-tube deformation portions 88 of the ink-passage valve assembly 92 is inflated to raise the pressure plate 89 to a position of the stoppers 100 against the biasing force of the pressure spring 90. As a result, the compression of the second electrode 96 against the elastic member 94 is released and the elastic member 94 restores the original shape by its restoration force to open the ink passage, thus allowing the pressure pump 78 to pump ink from the ink cartridge 76 to the liquid supply tube 71.

In the present illustrative embodiment, the first electrode 95 is disposed on the elastic member 94 that forms the ink passage along with the second electrode 96 moving up and down in response to air-pressure state. When air pressure is not applied, i.e., the ink passage is closed, as illustrated in FIG. 19B, the first electrode 95 is in contact with the second electrode 96 to be electrically conductive. Further, when air pressure is applied, as illustrated in FIG. 19A, the second electrode 96 is also in contact with the first electrode 95 with the stoppers 100 with the ink passage formed by the elastic member 94 having restored the original shape. Accordingly, when the ink cartridge 76 is a normal condition, the first electrode 95 and the second electrode 96 are electrically conductive regardless of the air pressure state.

By contrast, when the ink pack 76*a* of the ink cartridge 76 is out of ink, as illustrated in FIG. 19C, even if air pressure is applied, ink is not outputted from the ink pack 76*a* and the elastic member 94 remains collapsed. As a result, the first electrode 95 and the second electrode 96 are electrically discontinuous, allowing detection of the out-of-ink state (ink-end or ink-near-end state) in the ink cartridge 76.

Next, a fourth illustrative embodiment is described with reference to FIGS. 20 and 21.

Figure 20:
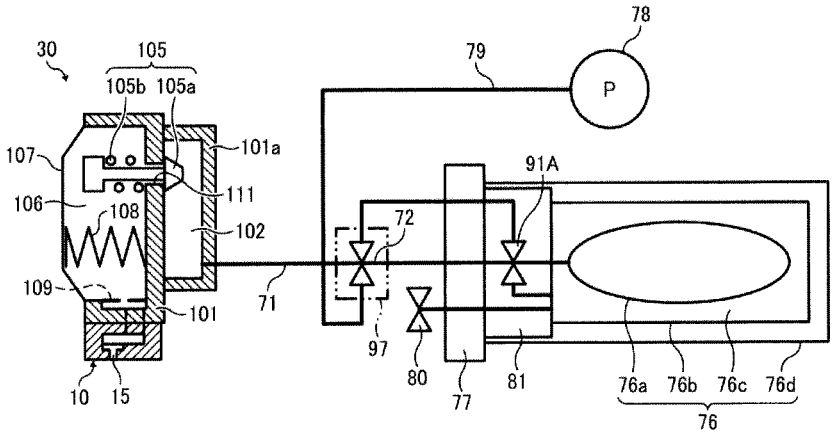
FIG. 20 is a schematic view illustrating a configuration of an ink supply system according to a fourth illustrative embodiment.
Figure 21:
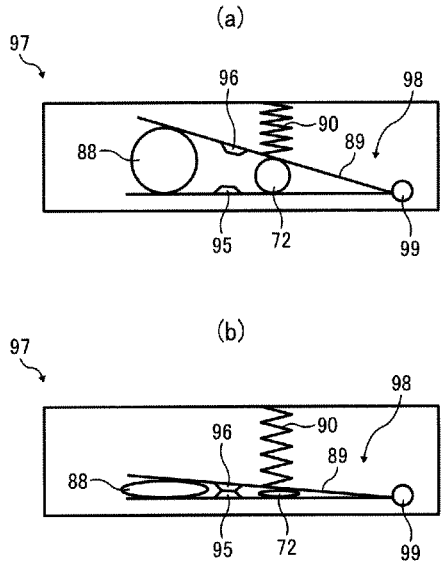
FIGS. 21A and 21B are schematic cross-sectional views illustrating operations of a second opening-and-closing assembly that opens and closes a liquid delivery tube between an ink cartridge and an inkjet recording apparatus.

FIG. 20 is a schematic view illustrating a configuration of an ink supply system according to the present illustrative embodiment. FIG. 21 is a schematic cross-sectional view illustrating operations of a second opening-and-closing assembly that opens and closes a liquid delivery tube 72 between an ink cartridge 76 and a liquid supply tube 71.

With the ink supply system, an ink-delivery valve assembly 97 is added as the second opening-and-closing assembly between the liquid supply tube 71 and the ink cartridge 76 to the configuration of the first illustrative embodiment.

The ink-delivery valve assembly 97 opens and closes a liquid delivery tube (deformable portion) 72 made of a flexible member disposed between the ink cartridge 76 and the liquid supply tube 71 by driving a pressure pump 78. In other words, as illustrated in FIG. 21, the ink-delivery valve assembly 97 includes a hinge unit 98 in which a pressure plate 89 pivots around a support point 99. The deformable liquid delivery tube 72 and an air-tube deformation portion 88 are sandwiched with the hinge unit 98, and the air-tube deformation portion 88 is disposed farther from the support point 99 than the liquid delivery tube 72. With respect to the portion sandwiched with the hinge unit 98, the liquid delivery tube 72 is made of an elastic material such as silicon rubber, and the air-tube deformation portion 88 is made of a flexible material such as a rubber tube or PET (polyethylene terephthalate) or other film materials.

The pressure plate 89 is constantly pressed by the pressure spring 90. When the pressure plate 89 is pressed, i.e., air is not pumped from the pressure pump 78, as illustrated in FIG. 21B, the air-tube deformation portion 88 is compressed. As a result, the liquid delivery tube 72 is also compressed to close the ink passage. By contrast, as illustrated in FIG. 21A, when the air-tube deformation portion 88 is inflated, i.e., air is pumped from the pressure pump 78, the inflation of the air-tube deformation portion 88 pushes the pressure plate 89 compressing the liquid delivery tube 72 upward against the biasing force of the pressure spring 90, thereby releasing the pressing of the pressure spring 90. As a result, the liquid delivery tube 72 restores the original shape by the elastic deformation thereof to open the ink passage.

When the inkjet recording apparatus including the ink supply system is not in operation, the air release valve 80 illustrated in FIG. 20 is opened and the passage of air connected to the air release valve 80 is not pressurized. At this time, in the ink-delivery valve assembly 97, as illustrated in FIG. 21B, the liquid delivery tube 72 is closed with the pressure spring 90, and at the same time, as described above, an ink-passage valve assembly 91 is also closed. Such a configuration prevents ink from being gradually sent to the recording head 10 when a residual pressure remains in the ink pack 76*a* of the ink cartridge 76.

When the ink cartridge 76 is removed from the inkjet recording apparatus, the ink passage is closed at both the ink-cartridge side and the inkjet-recording-apparatus side, thus preventing ink leakage.

By contrast, when the inkjet recording apparatus is activated for recording, the air release valve 80 illustrated in FIG. 20 is closed and the pressure pump 78 is driven to pump air into an air space 76*c* of the ink cartridge 76 via an air supply tube 79. As a result, the volume of the air-tube deformation portion 88 of the ink-delivery valve assembly 97 inflates to push the pressure plate 89 upward against the pressure spring 90 (see FIGS. 21A and 10). Thus, both the flexible tube member (ink passage) 85 and the liquid delivery tube 72 are opened, allowing ink to be delivered with the air pressure of the pressure pump 78 from the ink cartridge 76 to the liquid supply tube 71.

In the present illustrative embodiment, a first electrode 95 and a second electrode 96 are mounted on the two plates that are opened and closed with the hinge unit 98, allowing detection of deformation state of the air-tube deformation portion 88. Accordingly, if, as illustrated in FIG. 21A, the first electrode 95 and the second electrode 96 are separated from each other to be electrically discontinuous when the pressure pump 78 is driven to pump air into the air space 76*c* of the ink cartridge 76, it is detectable that the ink supply system is normal in operation. Further, if the first electrode 95 and the second electrode 96 are electrically conductive with the pressure pump 78 driven, it is detectable that the pressure pump 78 is out of order or air is leaking from the air passage, thus allowing determination of stopping the recording and so on.

By contrast, if the first electrode 95 and the second electrode 96 are electrically discontinuous with the air release valve 80 opened, it is detectable that a failure such as malfunction of the air release valve 80 or clogging of the air passage is occurring.

As described above, the ink supply system according to the present illustrative embodiment includes the recording head that ejects droplets of liquid, the ink cartridge including the flexible ink-storage member that stores ink to be supplied to the recording head, the pressure unit that pressurizes the ink storage member of the ink cartridge, the liquid delivery tube through which ink of the ink cartridge is delivered to the recording head, and the opening-and-closing assembly that opens and closes the liquid delivery tube. The opening-and-closing assembly is driven by the pressure unit. Thus, with such a simple configuration, the ink supply system according to the present illustrative embodiment prevents ink leakage when the ink cartridge is removed from the inkjet recording apparatus. The ink supply system also performs the opening and closing of the opening-and-closing assembly by using the pressure unit, thus allowing a further simplified configuration.

In the above descriptions, the cases in which ink is supplied from one ink cartridge 76 to one corresponding recording head 10 are described for simplicity. It is to be noted that the above-described configurations are applicable to an image forming apparatus that supplies a plurality of types (e.g., color types) of ink to a plurality of corresponding recording heads. In such a case, the ink supply system according to any of the above-described illustrative embodiments may be employed for each ink type. Alternatively, as illustrated in FIG. 22, the pressure pump 78 and the air release valve 80 may be commonly used for the plurality of types of ink, thus simplifying the pressurization system.

As one example of commonly using the pressure pump and the air release valve, a fifth illustrative embodiment in described with reference to FIG. 22.

Figure 22:
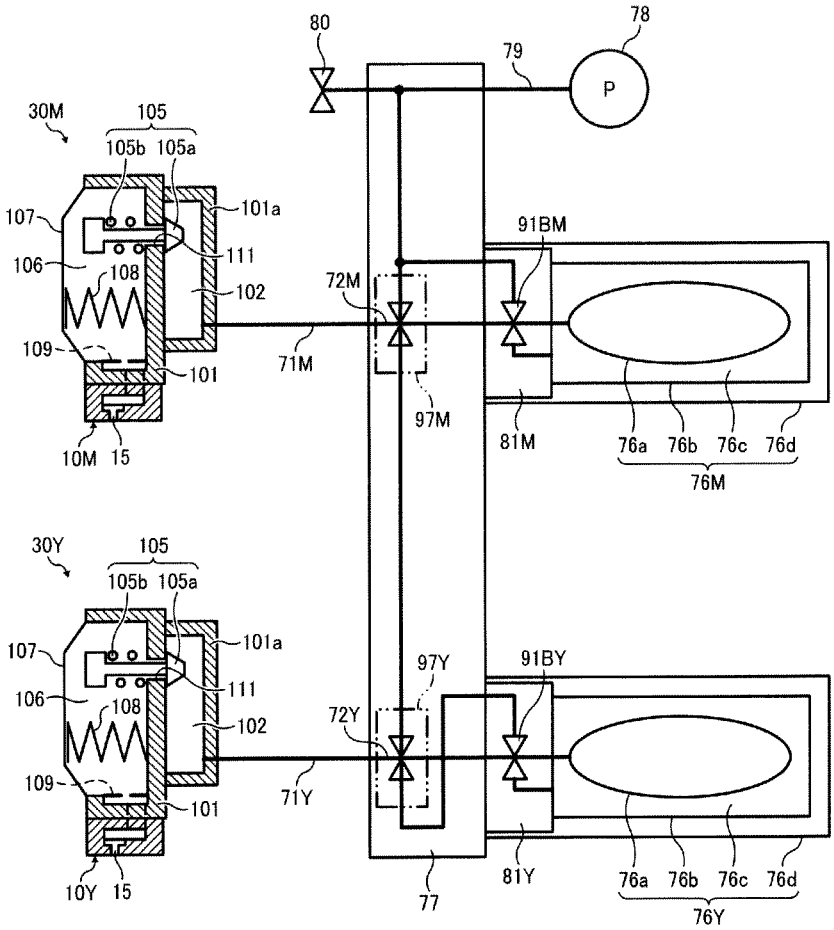
FIG. 22 is a schematic view illustrating a configuration of an ink supply system according to a fifth illustrative embodiment.

FIG. 22 is a schematic view illustrating a configuration of an ink supply system 5000 according to the fifth illustrative embodiment.

In FIG. 22, the ink supply system 5000 supplies two color inks from ink cartridges 76M and 76Y to corresponding recording heads 10M and 10Y. Each of the ink cartridges 76M and 76Y includes an ink-passage valve 91 having a configuration similar to the configuration of the ink-passage valve 91B illustrated in FIGS. 14 to 16 and an ink-delivery valve assembly 97, as illustrated in FIGS. 20 and 21, serving as an opening-and-closing assembly that opens and closes an ink supply passage at the inkjet-recording-apparatus side.

In this configuration, when air pressure is not applied, an air-tube deformation portion 88 in each of the ink-passage valve 91B and the ink-delivery valve assembly 97 opens the air passage, allowing formation of air flow from the pressure pump 78 to the ink cartridge 76 as illustrated in FIG. 22. Such a configuration can prevent ink from leaking in supplying two color inks with the pressure pump 78 and the air-release valve 80 commonly used for the two color inks.

As described above, the above-described illustrative embodiments allows driving of the ink-passage valve and/or the ink-passage delivery valve assembly with the driving source that pressurizes ink of the ink cartridge, delivering ink at high speed for recording, and preventing ink leakage when the driving source is inactive.

Next, an ink cartridge according to an illustrative embodiment is described with reference to FIGS. 23 and 24.

Figure 23:
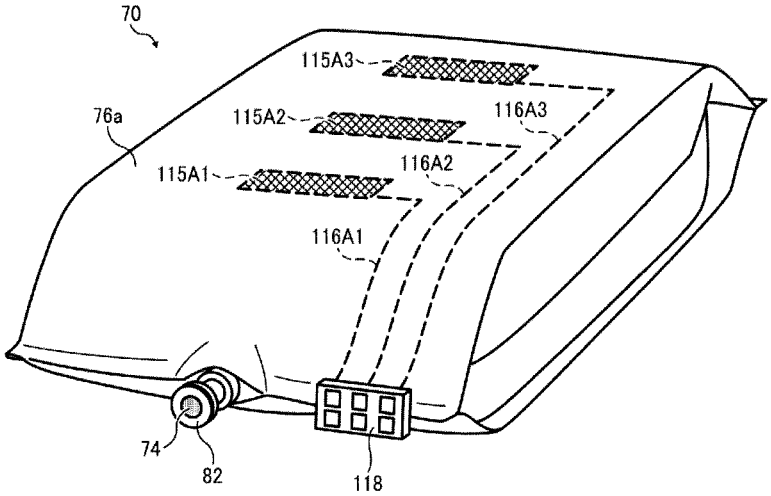
FIG. 23 is a perspective view illustrating a configuration of an ink pack assembly serving as a recording-liquid container according to illustrative embodiments of the present disclosure.
Figure 24:
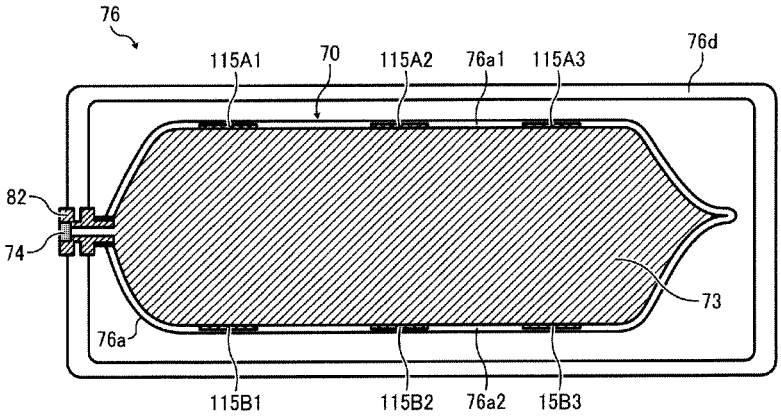
FIG. 24 is a schematic cross-sectional view illustrating an ink cartridge including an ink pack assembly housed in a cartridge case member as a recording-liquid container according to an illustrative embodiment.

FIG. 23 is a schematic perspective view illustrating an ink pack housed in the ink cartridge 76 serving as a liquid container. FIG. 24 is a schematic cross-sectional view illustrating the ink cartridge 76.

The ink cartridge 76 includes an ink pack assembly 70 and a case member 3 serving as a housing member that houses the ink pack assembly 70.

In a conventional technique like that described in JP-2006-327111-A, an ink cartridge may include a housing, an ink pack housed in the housing, two electrodes disposed to sandwich the ink pack, and reinforcement members that sandwich the two electrodes. In the ink cartridge, the electrodes move substantially parallel to each other regardless of the increase or decrease of ink in the ink pack.

However, with such a conventional ink cartridge, as the volume of the ink pack decreases, a portion of the ink pack at the bottom side is not pressed by the reinforcement members, causing ink to be pushed into the bottom side which is opposite the ink-supply side. Consequently, when the ink cartridge is in out-of-ink state, an increased amount of ink remains in the ink pack. Further, the above-described configuration may also cause increases in the mechanical components and production cost.

In the ink cartridge according to the present illustrative embodiment, an ink pack 76*a* of the ink pack assembly 70 is a deformable bag member made of a flexible sheet material and includes at least two sidewall faces 76*a*1 and 76*a*2 opposing each other. The ink pack 76*a* stores ink 73 that is a recording liquid. A supply port member 82 serving as a recording-liquid supply portion is fixed in the ink pack 76*a* by heat welding. The supply port member 82 receives a recording-liquid introduction member, e.g., a hollow nozzle member of the image forming apparatus. In the supply port member 82, an elastic member, such as a rubber-seal member 74, is disposed to prevent ink from leaking from the ink cartridge 76 when the ink cartridge 76 is mounted in, installed to, removed from, and detached from the image forming apparatus. The supply port member 82 of the ink pack 76*a* is mounted on one sidewall of the case member 3.

On the opposing sidewall faces 76*a*1 and 76*a*2 of the ink pack 76*a* are mounted opposing electrodes 115A1 and 115B1, opposing electrodes 115A2 and 115B2, and opposing electrodes 115A3 and 115B3, respectively (hereinafter, referred to as "electrodes 115" unless distinguished). In FIGS. 23 and 24, from a portion proximal to a portion distal to the supply port member 82, the electrodes 115A1 and 115B1, the electrodes 115A2 and 115B2, the electrodes 115A3 and 115B3 are arranged in this order. The electrodes 115A1, 115A2, and 115A3 are connected via leads 116A1, 116A2, and 116A3, respectively (hereinafter, referred to as "leads 116" unless distinguished) to an external electrode 118 that is mounted on a side of the ink pack 76*a* on which the supply port member 82 is mounted. The electrodes 115B1, 115B2, and 115B3 are also connected via leads, not illustrated, to the external electrode 118.

Figure 25:
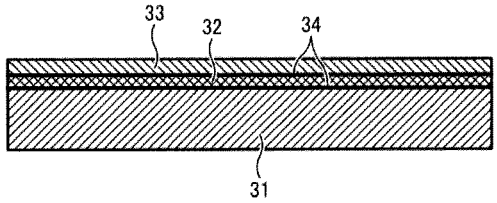
FIG. 25 is a schematic cross-sectional view illustrating an ink pack of the ink pack assembly.

The ink pack 76*a* is made of, e.g., a flexible sheet material of three layers. For example, as illustrated in FIG. 25, the three-layer sheet material is formed of a first layer 31 at the inner side (that contacts ink), a second layer 32 on the first layer 31, and a third layer 33 on the second layer 32. The first layer 31 is made of a non-conductive film, such as LDPE (low-density polyethylene). The second layer 32 is made of a conductive thin film such as aluminum or copper. The third layer 33 is made of a non-conductive film such as PE (polyethylene) or PET (polyethylene terephthalate). The first layer 31 and the second layer 32 are bonded with the second layer 32 and the third layer 33, respectively, by dry lamination.

Figure 26:
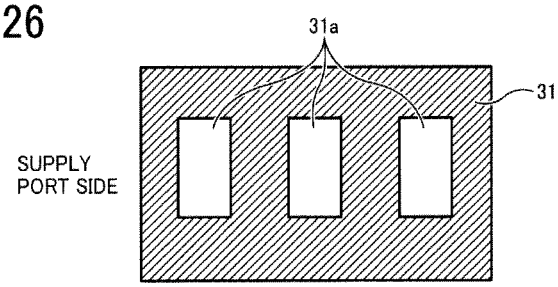
FIG. 26 is a schematic view illustrating a first layer provided at an inner side of the ink pack.
Figure 27:
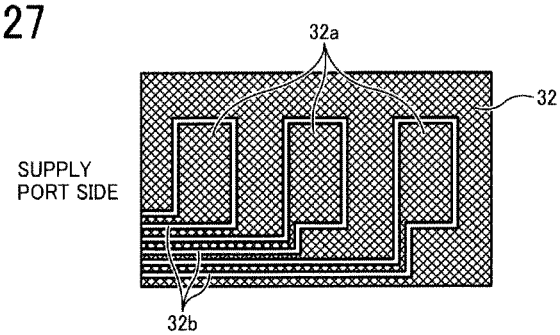
FIG. 27 is a schematic view illustrating a second layer of the ink pack.
Figure 28:
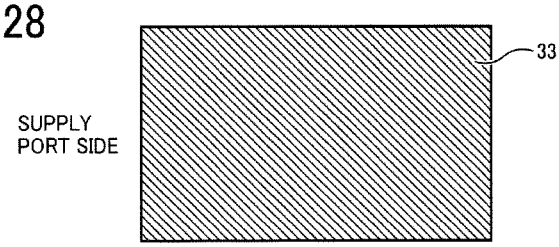
FIG. 28 is a schematic view illustrating a third layer of the ink pack.
Figure 29:
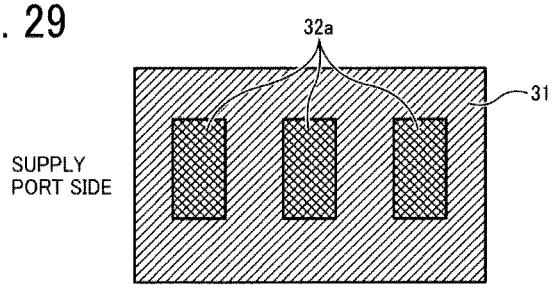
FIG. 29 is a schematic view illustrating relation between the first layer and the second layer forming electrodes with the first layer.
Figure 36:
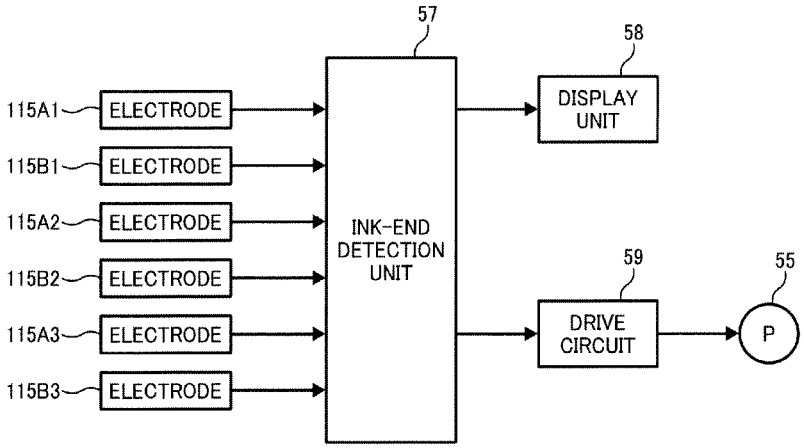
FIG. 36 is a block diagram illustrating a configuration of an ink-end detector of the ink supply system.
Figure 37:
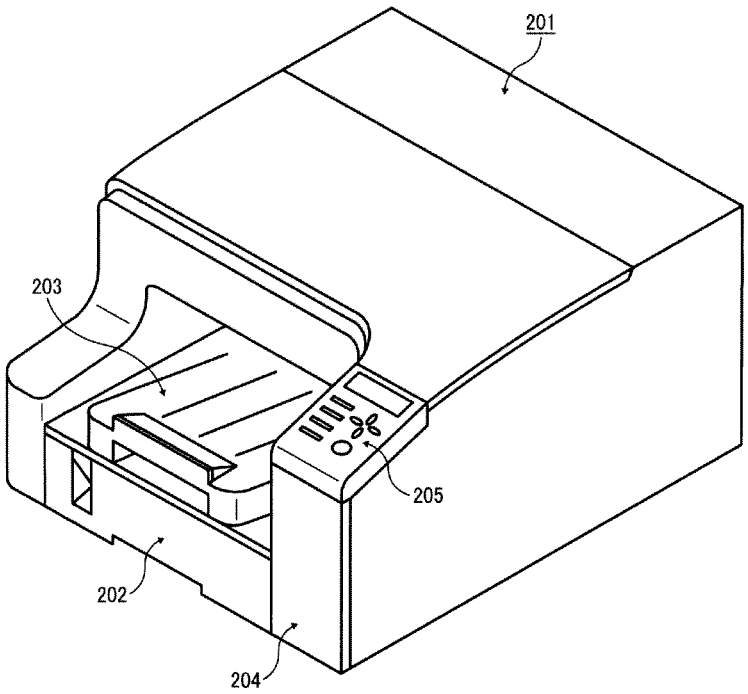
FIG. 37 is a schematic perspective view illustrating an image forming apparatus including a recording-liquid container according to an illustrative embodiment.
Figure 38:
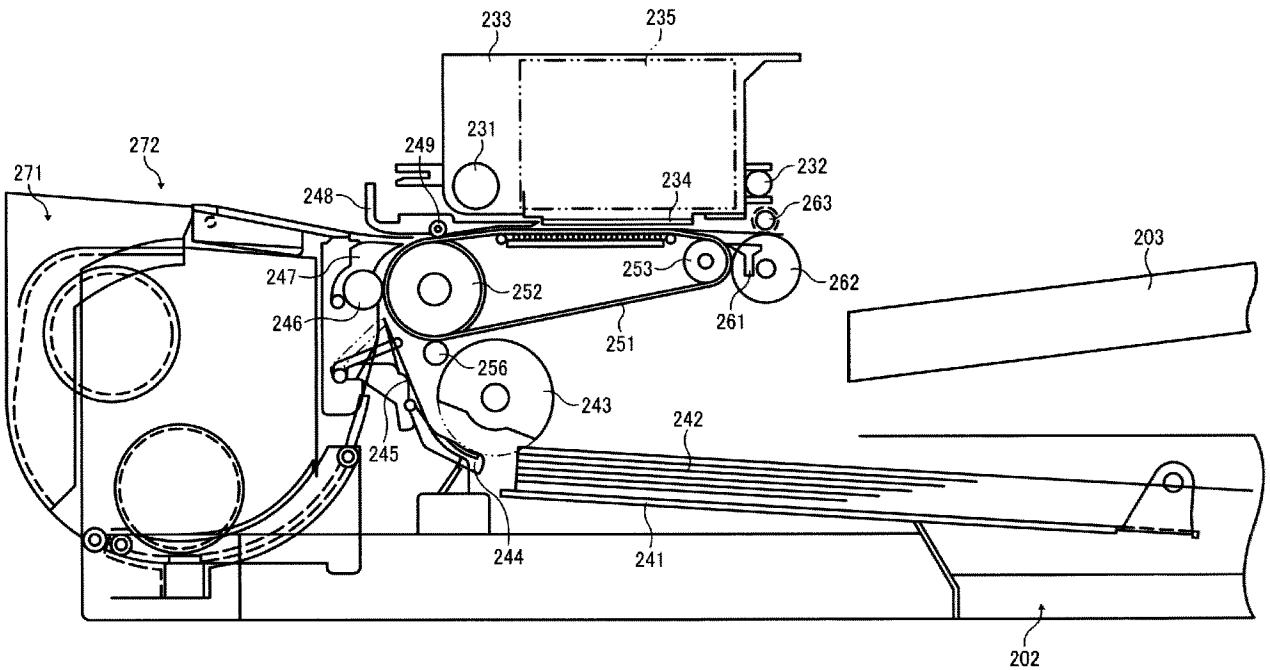
FIG. 38 is a schematic side view illustrating a mechanical section of the image forming apparatus.

As illustrated in FIG. 26, the first layer 31 has opening portions 31*a* corresponding to the respective electrodes 115. As illustrated in FIG. 27, in the second layer 32 is formed electrode patterns 32*a* that form the respective electrodes 115 and lead patterns 32*b* that form the leads 116 and the not-illustrated leads. The electrode patterns 32*a* and the lead patterns 32*b* corresponding the respective electrodes 115 are independent from each other and electrically separated from other areas. As illustrated in FIG. 28, the third layer 33 has a solid pattern. In FIGS. 36 to 38, the supply port member 82 is disposed at the left side of each layer, which is the same as in the following drawings.

Figure 30A:
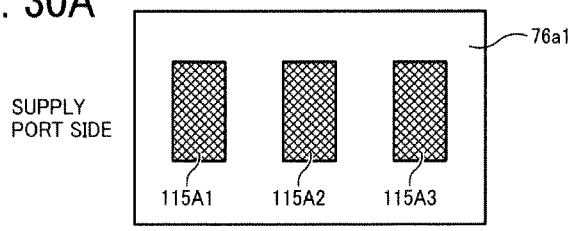
FIGS. 30A and 30B are schematic views illustrating an example of shape and arrangement of the ink pack.
Figure 30B:
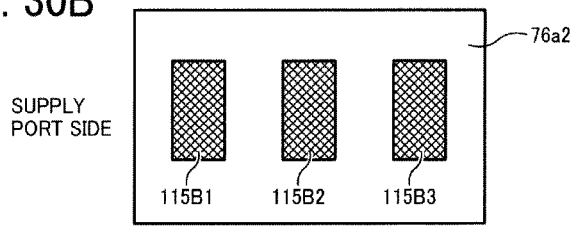

Thus, as illustrated in FIG. 30, at the inner face of the ink pack 76*a*, the electrodes 115 that are formed with the electrode patterns 32*a* of the second layer 32 are exposed from the first layer 31.

Forming a thin film of, e.g., electrically isolated aluminum or copper on the inner face of the first layer 31 allows to enhance the storage stability of ink.

Thus, as illustrated in FIG. 30, the electrodes 115A1, 115A2, and 115A3 are disposed at the sidewall face 76*a*1, and the electrodes 115B1, 115B2, and 115B3 are disposed at the sidewall face 76*a*2. The electrodes 115A1, 115A2, and 115A3 are disposed opposing the electrodes 115B1, 115B2, and 115B3, respectively, between the sidewall faces 76*a*1 and 76*a*2. In other words, an "electrode pair" or "electrode set" is formed with two opposing electrodes 115.

With such a configuration, as ink 73 decreases in the ink pack 76*a*, each pair of the opposing electrodes 115A1 and 115B1, the opposing electrodes 115A2 and 115B2, and the opposing electrodes 115A3 and 115B3 contacts each other. At this time, for example, when any one pair of the opposing electrodes 115 contacts to be electrically conductive, it is determined that the ink cartridge comes close to the ink-end state and an ink-near-end state is reported to a user. Further, when any two pairs of opposing electrodes 115 contact to be electrically conductive, it is determined that the ink cartridge comes further close to the ink end state, and at this stage, the ink-near-end state may be reported to the user. Further, when all of the three pairs of opposing electrodes 115 contact to be electrically conductive, it is determined that the ink cartridge is in the ink-end state, and replacing the ink pack 76*a* or the ink pack assembly 70 (or the ink cartridge 76) is prompted to a user.

Thus, the ink cartridge 76 includes the recording-liquid storage member formed with a deformable bag member having at least two opposing sidewall faces, a recording-liquid supply member that is mounted on the recording-liquid storage member and receives the recording-liquid introduction member of the image forming apparatus, and the plurality of opposing electrodes disposed on the respective sidewall faces of the recording-liquid storage member. Based on the contact state between the opposing electrodes, the residual amount of the recording liquid is detectable. Such a configuration allows to simplify the configuration of detection the residual amount of ink, reduce the production cost of the recording-liquid container, and reduce the unused amount of recording liquid in the recording-liquid container at the ink end state.

Next, another example of the shape and arrangement of electrodes is described with reference to FIGS. 31 to 34. In FIGS. 31 to 34, only the electrodes 115A1 to 115A3 at the sidewall face 76*a*1 are illustrated, and the sidewall face 76*a*2 is similarly configured.

Figure 31:
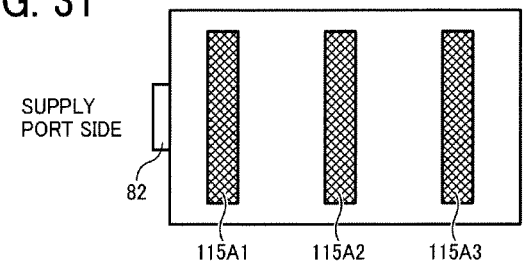
FIG. 31 is a schematic view illustrating an example of shape and arrangement of the ink pack.
Figure 32:
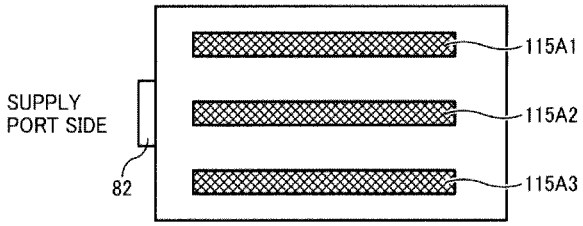
FIG. 32 is a schematic view illustrating an example of shape and arrangement of the ink pack.
Figure 33:
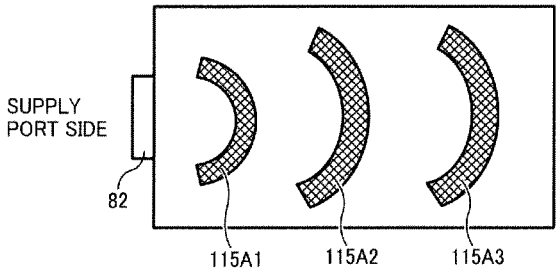
FIG. 33 is a schematic view illustrating an example of shape and arrangement of the ink pack.
Figure 34:
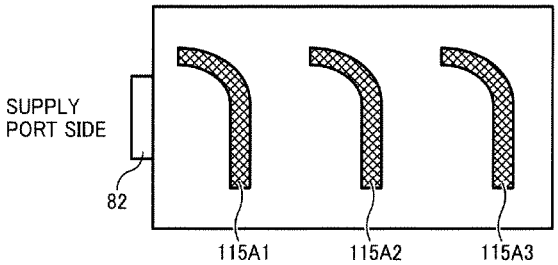
FIG. 34 is a schematic view illustrating an example of shape and arrangement of the ink pack.

In a first example illustrated in FIG. 31, three electrodes 115 (three sets of opposing electrodes) longer and thinner than the electrodes 115 according to the above-described illustrative embodiment are arranged from a portion of the ink pack 76*a* proximal to the supply port member 82 to a portion of the ink pack 76*a* distal to the supply port member 82. In a second example illustrated in FIG. 32, the three electrodes 115 having a shape elongated along an ink supply direction are arranged in a direction perpendicular to the ink supply direction. In a third example illustrated in FIG. 33, the three electrodes 115 are formed in arc shapes substantially around the supply port member 82 and arranged from a portion of the ink pack 76*a* proximal to the supply port member 82 to a portion of the ink pack 76*a* distal to the supply port member 82. In a fourth example illustrated in FIG. 34, the three electrodes 115 are formed in an arc shape substantially around the supply port member 82 at one end portion and a substantially straight shape at the other end portion, and arranged from a portion of the ink pack 76*a* proximal to the supply port member 82 to a portion of the ink pack 76*a* distal to the supply port member 82.

In the above-described illustrative embodiment, the plurality of opposing electrodes are described as three (sets of) electrodes. However, it is to be noted that the number of electrodes (electrode sets) is not limited to three (sets), and two (sets of) or four or more (sets of) electrodes may be employed. In the above-described illustrative embodiment, the ink cartridge serving as the recording-liquid container is formed with the ink pack assembly 70 housed in the case member 3.

Next, an ink supply system of an image forming apparatus employing the recording-liquid container according to the above-described illustrative embodiment is described with reference to FIG. 35.

Figure 35:
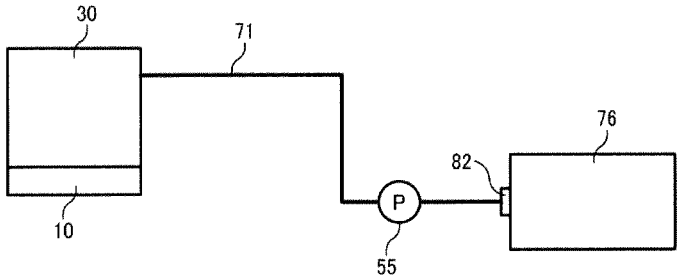
FIG. 35 is a schematic view illustrating an ink supply system of an image forming apparatus according to an illustrative embodiment.

FIG. 35 is a schematic view illustrating the ink supply system. In FIG. 35, a sub tank 30 serving as a secondary recording-liquid container is provided with the recording head 10 that ejects droplets of liquid as a single integrated unit. From the ink cartridge 76 serving as a main recording-liquid container removably mounted in the image forming apparatus, ink is supplied through the liquid supply tube 71. Ink is supplied with a supply pump (e.g., tube pump) 55 that is a reversible pump. As the ink cartridge 76, the electrodes 115 are arranged from a portion of the ink pack 76*a* proximal to the supply port member 82 to a portion of the ink pack 76*a* distal to the supply port member 82.

Next, an ink-end detector of the ink supply system is described with reference to FIG. 36.

FIG. 36 is a block diagram illustrating the ink-end detector. In the ink-end detector, a signal from each electrode 115 is inputted to an ink-end detection unit 57 via the external electrode 118 of the ink cartridge 76. As described above, when any one pair of the pairs of electrodes 115 becomes electrically conductive, it is determined that the ink cartridge 76 is close to the ink-end state, and a first ink-near-end state is displayed on a display unit 58 to notify a user. When any two pairs of the pairs of electrodes 115 become electrically conductive, it is determined that the ink cartridge 76 is quite close to the ink-end state, and a second ink-near-end state is displayed on the display unit 58 to notify the user. When all the pairs of electrodes 115 become electrically conductive, an ink-end state is displayed on the display unit 58 to prompt the user to replace the ink cartridge 76.

When the electrodes 115A1 and 115B1 of the ink cartridge 76 become conductive, the ink-end detection unit 57 causes the supply pump 55 to perform a reverse operation via a driving circuit 59. As a result, ink is returned to the ink pack 76*a* of the ink cartridge 76 to inflate the ink pack 76*a*.

Then, the ink-end detection unit 57 causes the supply pump 55 to perform a regular operation via the driving circuit 59 to supply ink from the ink cartridge 76 to the sub tank 30, and determines whether the electrodes 115A1 and 115B1 are non-conductive. At this time, if it is determined that the electrodes 115A1 and 115B1 are non-conductive, it suggests that the ink pack 76*a* is successfully prevented from being squeezed from a portion close to the supply port member 82. Even then, if the pair of the electrodes 115A1 and 115B1 contact before any other pair of the pairs of the electrodes 115 contacts, the above-described reverse operation (pumping) is repeated again.

As the residual amount of ink remaining in the ink pack 76*a* of the ink cartridge 76 decreases, the ink pack 76*a* deforms in different shapes. It is conceivable that the ink pack 76*a* is biased with, e.g., a spring to deform the ink pack 76*a* in a similar way each time. However, biasing with such a spring may cause a failure such as ink leakage or loss of balance in liquid-head difference, making it difficult to employ the spring or other biasing member. As a result, if the electrodes 115A1 and 115B1 proximal to the supply port member 82 of the ink pack 76*a* first contact each other, a portion of the ink pack 76*a* close to the supply port member 82 is squeezed, making it difficult to suction ink from a rear portion of the ink pack 76*a* distal to the supply port member 82. Consequently, ink of the ink pack 76*a* is not sufficiently consumed.

Hence, as described above, if the electrodes 115A1 and 115B1 proximal to the supply port member 82 are electrically conductive ahead of the electrodes 115A2 and 115B2 or the electrodes 115A3 and 115B3 more distal than the electrodes 115A1 and 115B1 to the supply port member 82, it is determined that a portion of the ink pack 76*a* close to the supply port member 82 is squeezed. Accordingly, ink is returned from the sub tank 30 to the ink pack 76*a* to inflate the ink pack 76*a*, thus allowing to reduce the non-used amount of ink.

An image forming apparatus according to an illustrative embodiment that employs the recording-liquid container is described with reference to FIGS. 36 to 39.

Figure 39:
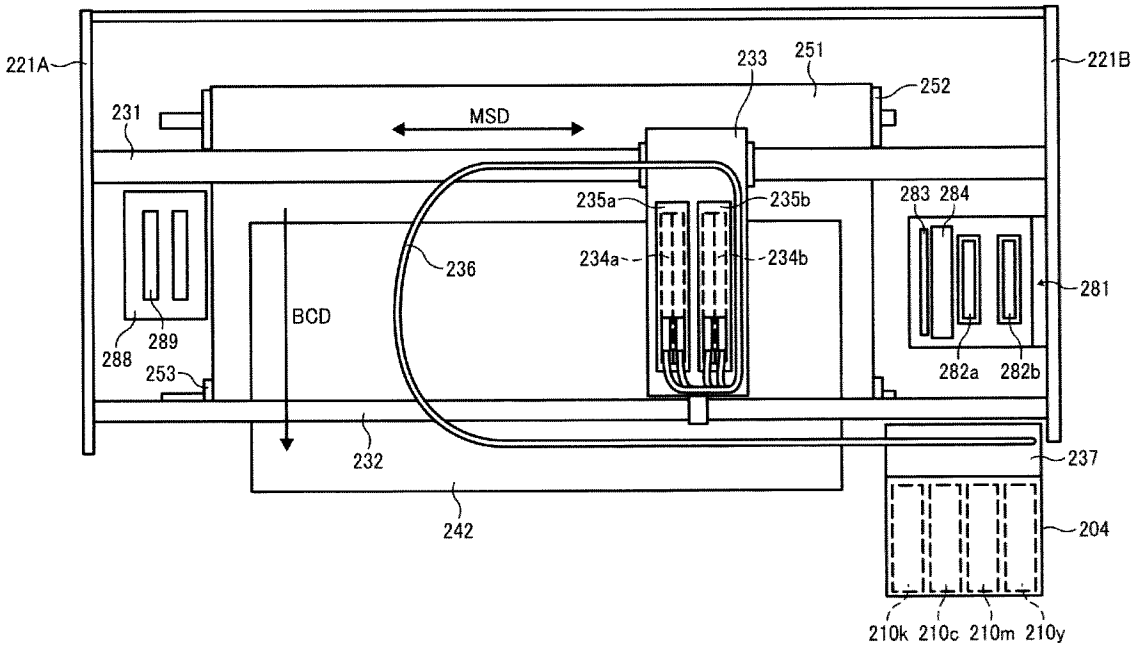
FIG. 39 is a schematic plan view illustrating the mechanical section of the image forming apparatus.

FIG. 37 is an external perspective view illustrating the image forming apparatus. FIG. 38 is a schematic side view illustrating a mechanical section of the image forming apparatus. FIG. 39 is a partial plan view illustrating the mechanical section illustrated in FIG. 38.

In FIGS. 37 to 39, the image forming apparatus 200 is illustrated as a serial-type inkjet recording apparatus. The image forming apparatus 200 includes a housing 201, a sheet feed tray 202, and a sheet output tray 203. The sheet feed tray 202 is mounted in the housing 201 so as to be extractable to a sheet refill position and stores sheets to be fed to a print section of the image forming apparatus. The sheet output tray 203 receives a sheet outputted after image recording (formation). The sheet output tray 203 is pivotably mounted on the housing so as to open and close an upper portion of the sheet feed tray 202, thus acting as a cover member of the sheet feed tray 202. Further, at one end portion of the front side of the housing 201 is disposed a cartridge mount portion 204 in which an ink cartridge(s) serving as the recording-liquid container according to the present illustrative embodiment is(are) mounted. At the top face of the cartridge mount portion 204 is mounted an operation-and-display unit 205 including operation buttons and a display.

In the image forming apparatus, both a main guide rod 231 and a sub guide rod 232 extend between side plates 201A and 201B to support a carriage 233 slidable in a main scan direction "MSD" indicated by a double arrow illustrated in FIG. 39. The carriage 233 moves for scanning by a main scan motor, not illustrated, via a timing belt.

On the carriage 233 are mounted recording heads 234*a* and 234*b* (hereinafter, collectively referred to as "recording heads 234" unless colors are distinguished) to eject ink droplets of different colors, e.g., yellow (Y), cyan (C), magenta (M), and black (K). In the recording heads 234, a plurality of nozzle rows consisting of nozzles is arranged in a sub-scan direction perpendicular to the main scan direction so as to eject ink droplets downward.

Each of the recording heads 234 may include two nozzle rows. For example, the recording head 234*a* may eject black ink droplets from one nozzle row and cyan ink droplets from the other nozzle row, and the recording head 234*b* may eject magenta ink droplets from one nozzle row and yellow ink droplets from the other nozzle row.

On the carriage 233 are mounted sub tanks 235*a* and 235*b* (hereinafter collectively referred to as "sub tanks 235" unless colors are distinguished) serving as secondary recording-liquid containers that supply color inks corresponding to the respective nozzle rows of the recording heads 234. The sub tanks 235*a* and 235*b* may be formed with the carriage 233 as a single integrated unit. With a pump unit 237 including the supply pump 55, color inks are supplied from the ink cartridges 210, which are the main recording-liquid containers, to the head tanks 235 via supply tubes 236.

The image forming apparatus 200 further includes a sheet feed section that feeds sheets 242 stacked on a sheet stack portion (platen) 241 of the sheet feed tray 202. The sheet feed section further includes a sheet feed roller 243 that separates the sheets 242 from the sheet stack portion 241 and feeds the sheets 242 sheet by sheet and a separation pad 244 that is disposed opposing the sheet feed roller 243. The separation pad 244 is made of a material of a high friction coefficient and biased toward the sheet feed roller 243.

To feed the sheet 242 from the sheet feed section to a portion below the recording heads 234, the image forming apparatus 200 includes a first guide member 245 that guides the sheet 242, a counter roller 246, a conveyance guide member 247, a press member 248 including a front-end press roller 249, and a conveyance belt 251 that conveys the sheet 242 to a position facing the recording heads 234 with the sheet 242 electrostatically attracted thereon.

The conveyance belt 251 is an endless belt that is looped between a conveyance roller 252 and a tension roller 253 so as to circulate in a belt conveyance direction "BCD", that is, the sub-scan direction. A charge roller 256 is provided to charge the surface of the conveyance belt 251. The charge roller 256 is disposed to contact the surface of the conveyance belt 251 and rotate depending on the circulation of the conveyance belt 251. By rotating the conveyance roller 252 by a sub-scan motor, not illustrated, via a timing roller, the conveyance belt 251 circulates in the belt conveyance direction "BCD" illustrated in FIG. 39.

The image forming apparatus 200 further includes a sheet output section that outputs the sheet 242 on which an image has been formed by the recording heads 234. The sheet output section includes a separation claw 261 that separates the sheet 242 from the conveyance belt 251, a first output roller 262, a second output roller 263, and the sheet output tray 203 disposed below the first output roller 262.

A duplex unit 271 is removably mounted on a rear portion of the image forming apparatus 200. When the conveyance belt 251 rotates in reverse to return the sheet 242, the duplex unit 271 receives the sheet 242 and turns the sheet 242 upside down to feed the sheet 242 between the counter roller 246 and the conveyance belt 251. At the top face of the duplex unit 271 is formed a manual-feed tray 272.

In FIG. 39, a maintenance unit 281 is disposed at a non-print area on one end in the main-scan direction of the carriage 233. The maintenance unit 281 including a recovery device maintains and recovers nozzles of the recording heads 234. The maintenance unit 281 includes caps 282*a* and 282*b* (hereinafter collectively referred to as "caps 282" unless distinguished) that cover the nozzle faces of the recording heads 234, a wiping blade 283 that is a blade member to wipe the nozzle faces of the recording heads 234, and a first droplet receiver 284 that receives ink droplets during maintenance ejection performed to discharge increased-viscosity ink.

In FIG. 39, a second droplet receiver 288 is disposed at a non-print area on the other end in the main-scan direction of the carriage 233. The second droplet receiver 288 receives ink droplets that are ejected to discharge increased-viscosity ink in recording (image forming) operation and so forth. The second droplet receiver 288 has openings 289 arranged in parallel with the rows of nozzles of the recording heads 234.

In the image forming apparatus 200 having the above-described configuration, the sheet 242 is separated sheet by sheet from the sheet feed tray 202, fed in a substantially vertically upward direction, guided along the first guide member 245, and conveyed with sandwiched between the conveyance belt 251 and the counter roller 246. Further, the front tip of the sheet 242 is guided with a conveyance guide 237 and pressed with the front-end press roller 249 against the conveyance belt 251 so that the traveling direction of the sheet 242 is turned substantially 90 angle degrees. The sheet 242 is attracted on the charged conveyance belt 251 and conveyed in the sub scanning direction by circulation of the conveyance belt 251.

By driving the recording heads 234 in response to image signals while moving the carriage 233, ink droplets are ejected on the sheet 242 stopped below the recording heads 234 to form one band of a desired image. Then, the sheet 242 is fed by a certain amount to prepare for recording another band of the image. Receiving a signal indicating that the image has been recorded or the rear end of the sheet 242 has arrived at the recording area, the recording heads 234 finishes the recording operation and outputs the sheet 242 to the sheet output tray 203.

The image forming apparatus 200 detects the ink-near-end state or ink-end state of the ink cartridge 210 with the ink-end detection unit 57.

As described above, the image forming apparatus includes the ink cartridge (or ink pack) as the recording-liquid container according to the above-described illustrative embodiments. Accordingly, by detecting the residual amount of ink remaining in the ink cartridge, the image forming apparatus 200 can reduce the amount of ink not finished up in the ink cartridge 76 and the running cost.

In the above-described illustrative embodiment, the case in which the recording liquid is ink is described. As described above, the recording liquid may be developing agent or toner used in the image forming apparatus.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different illustrative embodiments may be combined with each other and/or substituted for each other within the scope of this disclosure and appended claims.

What is claimed is:

1. An ink cartridge removably mountable in an image forming apparatus, the ink cartridge comprising:

a flexible storage member that stores ink;

a pressurization-space formation member that hermetically houses the storage member and forms a pressurization space to which a fluid is supplied between the pressurization-space formation member and the storage member;

an output port connected to the storage member, through which the ink is supplied from the storage member to the image forming apparatus; and an opening-and-closing assembly that opens and closes between the output port and the storage member by the fluid supplied into the pressurization space, wherein the opening-and-closing assembly is configured to open when the fluid is supplied into the pressurization space and to close when the fluid is not supplied into the pressurization space, wherein the opening-and-closing assembly causes the output port and the storage member to communicate when a pressurization device of the image forming apparatus supplies the fluid to the pressurization space to apply pressure on the storage member, wherein the opening-and-closing assembly comprises an ink passage member that connects the storage member and the output port, the ink passage member having a first deformable portion, and a fluid passage member through which the fluid is supplied to the pressurization space and including a second deformable portion, and wherein, deformation of the second deformable portion of the fluid passage member by the fluid supplied to the pressurization space causes the first deformable portion of the ink passage member to open the ink passage member.

2. The ink cartridge according to claim 1, wherein the fluid is supplied from the image forming apparatus to the pressurization space.

3. The ink cartridge according to claim 1, wherein the opening-and-closing assembly further comprises a press member biased in a direction to compress the first deformable portion of the ink passage member and the second deformable portion of the fluid passage member.

4. The ink cartridge according to claim 1, wherein, when the fluid is not supplied to the pressurization space, the opening-and-closing assembly closes the ink passage member and opens the fluid passage member.

5. The ink cartridge according to claim 1, further comprising a detector that detects opening and closing of the opening-and-closing assembly.

6. The ink cartridge according to claim 1, wherein the opening-and-closing assembly comprises one or more deformable portions configured to become inflated when the fluid is supplied into the pressurization space, causing the opening-and-closing assembly to open, and to become deflated when the fluid is not supplied into the pressurization space, causing the opening-and-closing assembly to close.

7. An image forming apparatus, comprising:

a recording head that ejects droplets of ink;

an ink cartridge including a storage member that stores ink to be delivered to the recording head;

a pressurization device that applies pressure on the storage member of the ink cartridge;

a delivery tube through which ink of the ink cartridge is delivered to the recording head; and an opening-and-closing assembly driven with the pressurization device to open and close the delivery tube, wherein the opening-and-closing assembly is configured to open the delivery tube when the pressurization device applies the pressure on the storage member and to close the delivery tube when the pressurization device does not apply the pressure on the storage member, wherein, when the pressurization device pressurizes the storage member of the ink Cartridge, the opening-and-closing assembly opens the deliver tube wherein the pressurization device pressurizes the storage member with the fluid, wherein the opening-and-closing assembly includes a first deformable portion of the delivery tube, a fluid passage member through which the fluid is supplied to the pressurization space and including a second deformable portion, and a press member biased in a direction to compress the first deformable portion of the deliver tube and the second deformable portion of the fluid passage member, and wherein deformation of the second deformable portion of the fluid passage member by the fluid supplied to the pressurization space causes the first deformable portion of the delivery tube to open the ink passage member.

8. The image forming apparatus according to claim 7 , wherein, when pressure is not applied on the storage member of the ink cartridge from the pressurization device, the opening-and-closing assembly closes the delivery tube and opens the fluid passage member.

9. The image forming apparatus according to claim 7, further comprising a detector that detects opening and closing of the opening-and-closing assembly.

10. A recording-liquid container used in an image forming apparatus to store a recording liquid, the container comprising:

a deformable storage member that stores the recording liquid, the storage member having at least two deformable opposing side walls;

a recording-liquid supply member mounted on the storage member to receive a recording-liquid introduction member of the image forming apparatus;

a plurality of electrodes disposed on the at least two deformable opposing side walls of the storage member, each particular electrode of the plurality of electrodes disposed on one of the opposing side walls forming an electrode pair with another electrode disposed on another one of the opposing side walls, the electrode pair being in a contact state when said particular electrode and said another electrode are in contact with each other; and a detection circuit coupled to the plurality of electrodes to detect a number of electrode pairs of the plurality of electrodes which are in the contact state and generates, based on the detected number, a stepwise signal corresponding to one of at least two levels of the recording liquid in the storage member, and wherein when all of the electric pairs are in the contact state, the stepwise signal generated by the detection circuit indicates that the storage member is empty and needs to be replaced.

11. The recording-liquid container according to claim 10, wherein the storage member comprises at least three laminated layers, the at least three layers including an interior first layer of a non-conductive material, an intermediate second layer of a conductive material, and an exterior third layer of a non-conductive material, the at least three layers disposed such that the interior first layer contacts the recording liquid contained in the recording-liquid container.

12. The recording-liquid container according to claim 11, wherein the plurality of electrodes is formed in the intermediate second layer of the conductive material.

13. The recording-liquid container according to claim 10, further comprising an outer case member that houses the storage member.

14. An image forming apparatus, comprising a recording-liquid container according to claim 10.

15. The image forming apparatus according to claim 14, wherein the plurality of opposing electrodes is arranged from a portion of the storage member proximal to the recording-liquid supply member to a portion of the storage member distal to the recording-liquid supply member, the image forming apparatus further comprising:

a second recording-liquid container that temporarily stores the recording-liquid supplied from the first recording-liquid container;

a delivery unit that delivers the recording-liquid between the recording-liquid containers; and a controller causing the recording-liquid to be delivered in reverse from the second recording-liquid container to the storage member of the first recording-liquid container when opposing electrodes of the first recording-liquid container distal to the recording-liquid supply member are not in contact with each other and opposing electrodes of the first recording-liquid container proximal to the recording-liquid supply member are in contact with each other.

* * * * *